US009308722B2

(12) United States Patent
Ishida et al.

(10) Patent No.: US 9,308,722 B2
(45) Date of Patent: Apr. 12, 2016

(54) LIQUID EJECTION HEAD AND LIQUID EJECTION APPARATUS

(71) Applicant: CANON KABUSHIKI KAISHA, Tokyo (JP)

(72) Inventors: Yuzuru Ishida, Yokohama (JP); Sadayoshi Sakuma, Oita (JP); Norihiro Yoshinari, Kawasaki (JP); Ichiro Saito, Yokohama (JP); Maki Kato, Fuchu (JP); Kenji Takahashi, Yokohama (JP); Yoshinori Misumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/511,427

(22) Filed: Oct. 10, 2014

(65) Prior Publication Data

US 2015/0109371 A1 Apr. 23, 2015

(30) Foreign Application Priority Data

Oct. 18, 2013 (JP) ..... 2013-217202

(51) Int. Cl.
*B41J 2/05* (2006.01)
*B41J 2/14* (2006.01)

(52) U.S. Cl.
CPC ..... *B41J 2/1404* (2013.01); *B41J 2/14129* (2013.01); *B41J 2/14145* (2013.01)

(58) Field of Classification Search
None
See application file for complete search history.

(56) References Cited

U.S. PATENT DOCUMENTS

| | | | | |
|---|---|---|---|---|
| 7,950,769 | B2 | 5/2011 | Sakai et al. | |
| 7,980,656 | B2 | 7/2011 | Sakurai et al. | |
| 8,123,330 | B2 | 2/2012 | Sakai et al. | |
| 8,491,087 | B2 | 7/2013 | Sakai et al. | |
| 2007/0146428 | A1 * | 6/2007 | Sakai et al. | 347/50 |
| 2015/0029267 | A1 | 1/2015 | Kato et al. | |

FOREIGN PATENT DOCUMENTS

| | | | |
|---|---|---|---|
| JP | 2008-105364 | A | 5/2008 |

* cited by examiner

*Primary Examiner* — Erica Lin
(74) *Attorney, Agent, or Firm* — Fitzpatrick, Cella, Harper & Scinto

(57) ABSTRACT

In a liquid ejection head for ejecting liquid by using thermal energy, reduction of film thickness caused by elution of a protective layer when kogation on the protective layer is removed is made uniform and decrease in liquid ejection performance is suppressed. More specifically, a counter electrode is provided around a portion on which an ejection port of a flow path forming member is formed.

18 Claims, 23 Drawing Sheets

LIQUID EJECTION HEAD AND LIQUID EJECTION APPARATUS

BACKGROUND OF THE INVENTION

1. Field of the Invention

The present invention relates to a liquid ejection head and a liquid ejection apparatus, and more particularly to the configuration of removing so-called kogation on a heat acting portion in a liquid ejection head for ejecting liquid such as ink by causing heat to act on the liquid to generate bubbles.

2. Description of the Related Art

In a liquid ejection head having a system of using thermal energy generated by an electrothermal transducer element to generate bubbles in liquid such as ink to eject the liquid, so-called kogation occurs on a heat acting portion and thereby the heat conduction from the heat acting portion to the liquid becomes uneven. This may occasionally cause unstable ejection.

In this respect, Japanese Patent Laid-Open No. 2008-105364 discloses providing an area which includes a heat acting portion with an upper protective layer acting as an electrode for generating an electrochemical reaction with ink, allowing the surface of the upper protective layer to be eluted, and removing kogation on the heat acting portion. In this configuration, for the arrangement of electrodes to generate the electrochemical reaction, the upper protective layer on the heat acting portion is set as an anode and a layer formed on the same plane as the upper protective layer is set as a cathode. That is, the anode and the cathode are located in parallel on a substrate.

SUMMARY OF THE INVENTION

In a first aspect of the present invention, there is provided a liquid ejection head comprising: a heating section, a protective film provided above the heating section, an electrode capable of generating a voltage between the protective film and the electrode; and an ejection port, so as to eject liquid from the ejection port with use of heat generated by the heating section via the protective film, wherein the protective film and the electrode are arranged such that a distance between the protective film and the electrode satisfies $1<a/b\leq 2$ when a maximum distance is set as "a" and a minimum distance is set as "b".

Further features of the present invention will become apparent from the following description of exemplary embodiments (with reference to the attached drawings).

DESCRIPTION OF THE EMBODIMENTS

In the configuration of Japanese Patent Laid-Open No. 2008-105364, in a process of dissolving an upper protective layer on a heat acting portion by an electrochemical reaction, a dissolution level of the upper protective layer may occasionally be uneven. More specifically, a distance between the cathode and the upper protective layer as an anode varies depending on a portion on the upper protective layer, and accordingly, a resistance at the timing of dissolution varies. This causes a variation in an elution amount of a surface layer depending on a portion on the upper protective layer when kogation is removed, and as a result, the film thickness of the upper protective layer becomes uneven. In this case, the heat conduction from the heat acting portion to liquid via the upper protective layer becomes uneven, leading to a decrease in liquid ejection performance.

An object of the present invention is to provide a liquid ejection head and a liquid ejection apparatus capable of making the reduction of the film thickness caused by elution of the protective layer when kogation on the protective layer is removed uniform, and controlling a decrease in liquid ejection performance.

Embodiments of the present invention will be described with reference to the attached drawings.

First Embodiment

Ink jet printing apparatus

Figure 1:
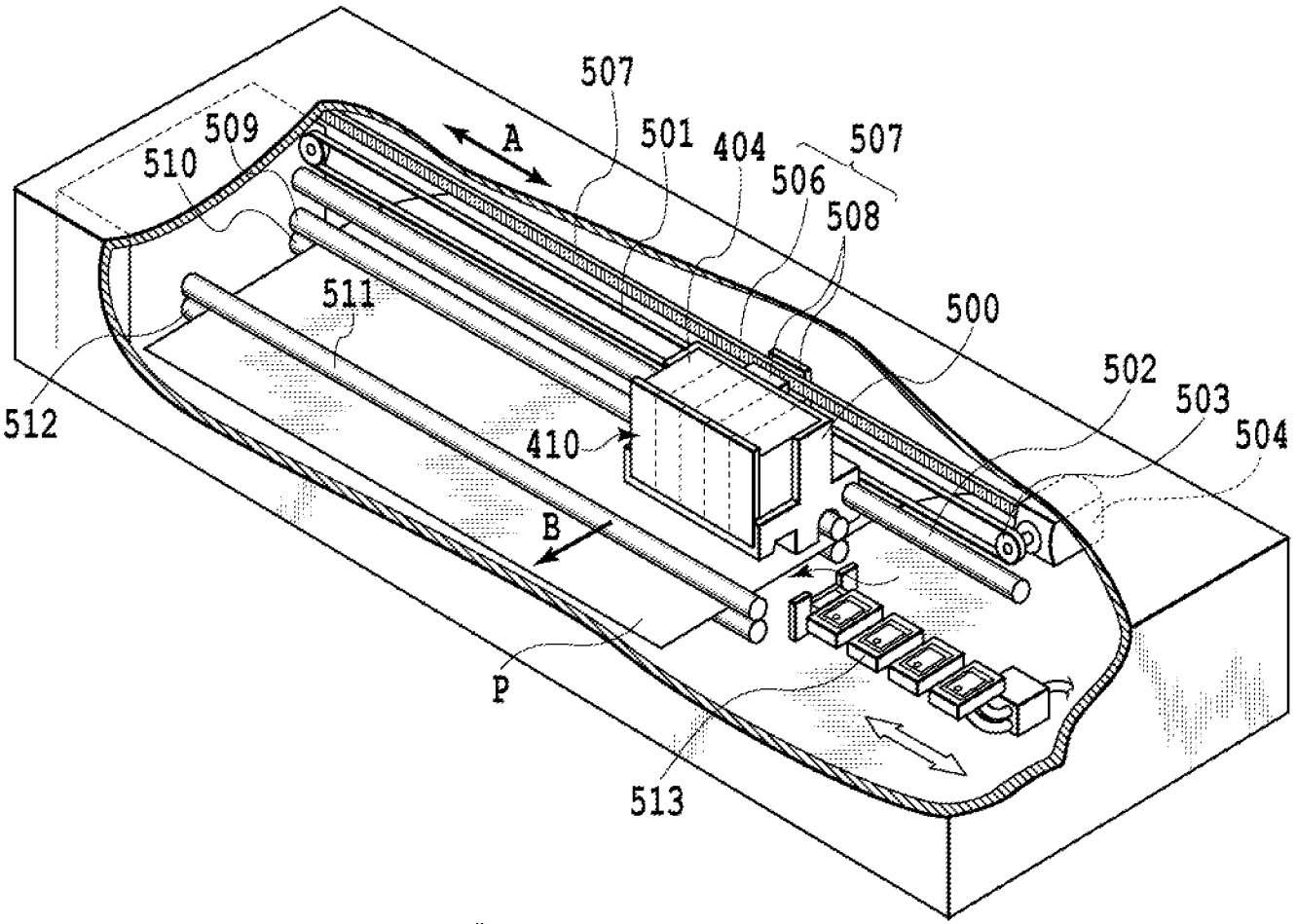
FIG. 1 is a perspective view of an ink jet printing apparatus which is one embodiment of a liquid ejection apparatus of the present invention.

FIG. 1 is a perspective view of an ink jet printing apparatus which is one embodiment of a liquid ejection apparatus according to the present invention. In FIG. 1, a carriage 500 is configured to removably mount an ink jet cartridge 410 in which a print head and an ink tank are integrally formed and to be slidably supported by a guide 502. The carriage 500 can move along the guide 502 by a driving force of a carriage motor 504 transmitted via a timing belt 501 provided in a stretched manner by an idler pulley 503. The movement of the carriage 500 allows movement (scanning) of the print head on the ink jet cartridge 410 in a main scanning direction for printing. For each print head scan, a print medium is conveyed in a direction (sub-scanning direction) crossing the main scanning direction by a pair of rollers consisting of a conveying roller (not shown) and a pinch roller (not shown) in an amount corresponding to a width of an area printed by one scan. The movement of the print head in the main scanning direction and the conveyance of the print medium in the sub-scanning direction are repeated alternately to print an image on the print medium. At the start of printing or during printing, the carriage moves to a home position as necessary, whereby suction recovery processing or preliminary ejection processing of the print head can be performed.

When performing the processing of removing kogation adhering to a protective layer (protective film) in the print head, which will be described later, the ink jet printing apparatus performs control to generate a potential difference between the protective layer and a counter electrode. Incidentally, the counter electrode means an electrode capable of applying a voltage between the protective layer and the counter electrode, and the position of the counter electrode is not specified.

Ink Jet Cartridge

Figure 2:
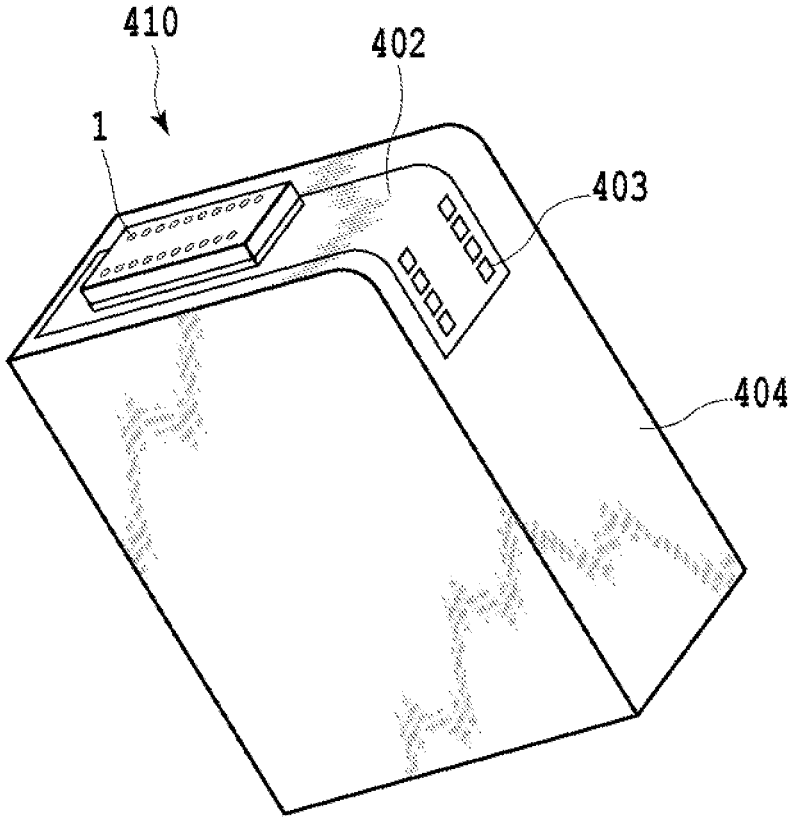
FIG. 2 is a perspective view of an ink jet cartridge according to one embodiment of the present invention.

FIG. 2 is a perspective view of an ink jet cartridge according to one embodiment of the present invention. The ink jet cartridge 410 includes, as described above, a print head substrate 1 forming a print head, an electric wiring tape (flexible wiring board) 402, and an electric contact portion 403 for electrically connecting with a printing apparatus main body. The ink jet cartridge 410 further includes an ink containing portion 404 forming an ink tank.

Print Head Substrate

Figure 3:
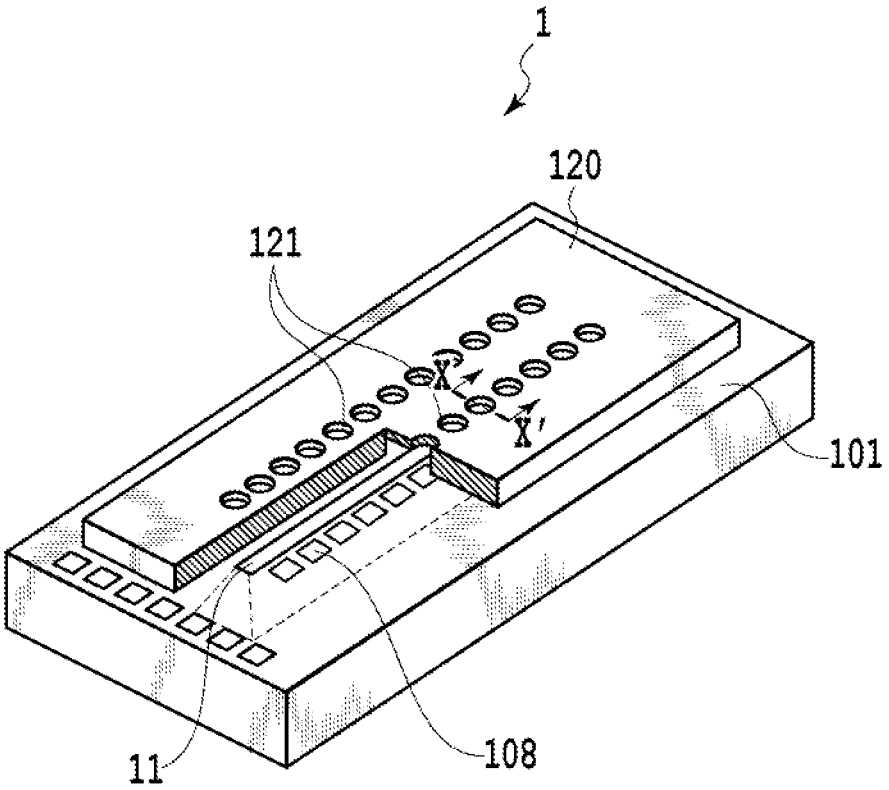
FIG. 3 is a partly cutaway perspective view of a substrate forming a print head according to one embodiment of the present invention.

FIG. 3 is a partly cutaway perspective view of a substrate forming a print head according to an embodiment of the present invention. The print head substrate 1 is generally formed by providing a flow path forming member 120 on a silicon base member 101. The flow path forming member 120 has a plurality of ejection ports 121 for ejecting ink arranged at predetermined intervals. Meanwhile, the silicon base member 101 is provided with a heat acting portion 108 corresponding to each of the ejection ports 121. The heat acting portion 108 is a portion corresponding to the ejection port and including a heating resistor, an electrode for supplying a current through the heating resistor, and a protective film provided above them, as will be described with reference to FIG. 5. Heat generated at this portion is used to generate a bubble in ink and the ink is ejected from the corresponding ejection port. An ink supply port 11 penetrating the silicon base member 101 is provided at an area between arrays of the heat acting portions 108. Ink is supplied from the ink containing portion 404 to each of the heat acting portions 108 via the ink supply port 11.

Figure 4A:
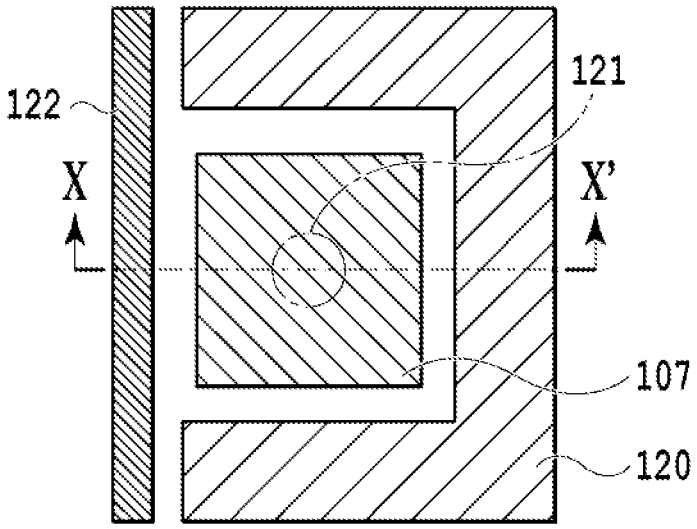
FIG. 4A is a top view of the vicinity of a heat acting portion on a print head substrate of a conventional example as viewed from the top of an ejection port.
Figure 4B:
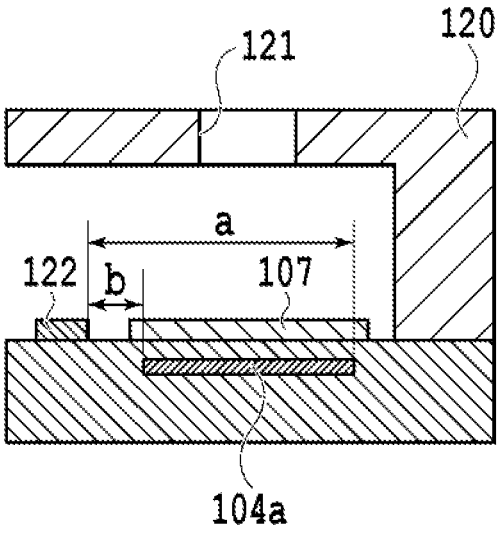
FIG. 4B is a cross-sectional view taken along line X-X' of FIG. 4A.
Figure 4C:
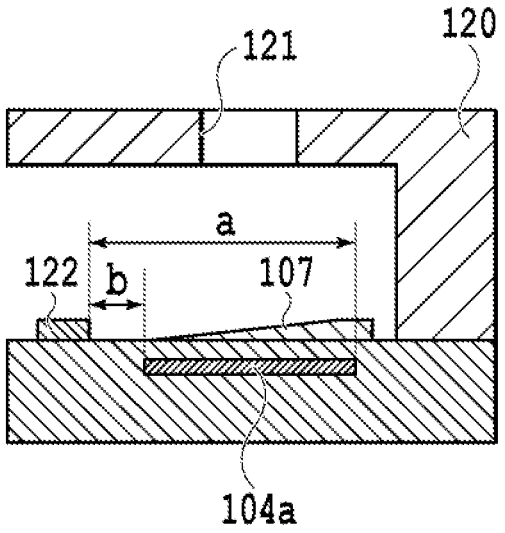
FIG. 4C illustrates a change in film thickness of an upper protective layer due to elution on the print head substrate of the conventional example.
Figure 5:
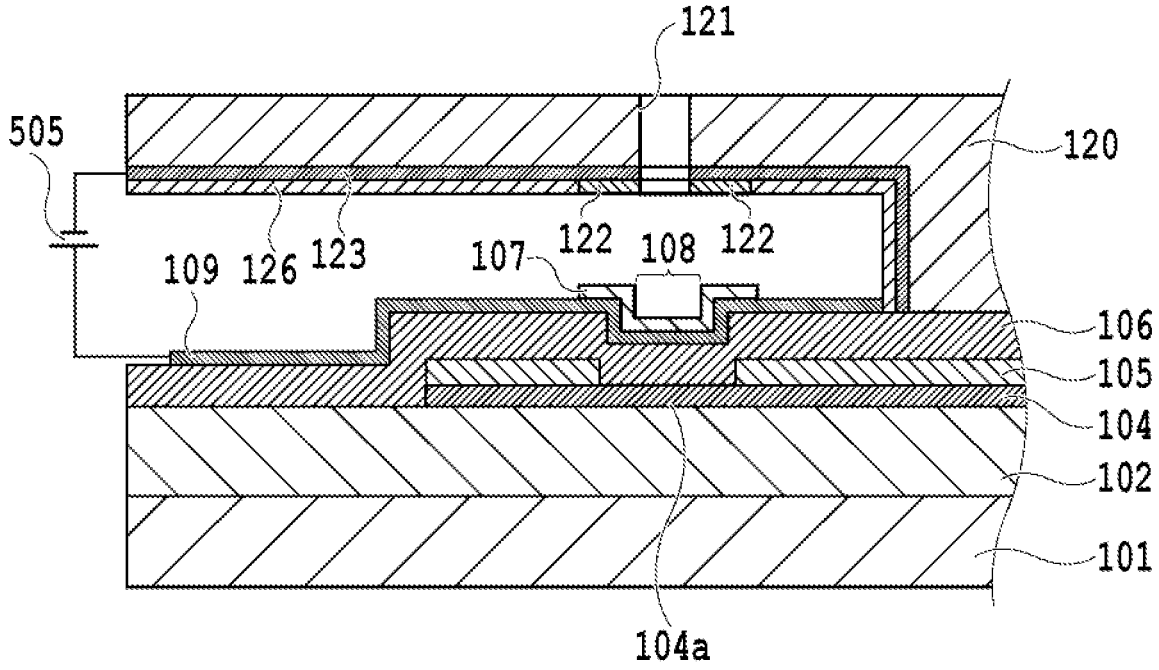
FIG. 5 is a cross-sectional view of the print head substrate taken along line X-X' of FIG. 3 according to a first embodiment of the present invention.

FIG. 4A is a top view of the vicinity of a heat acting portion on a print head substrate of a conventional example as viewed from the top of an ejection port. FIG. 4B is a cross-sectional view taken along line X-X' of FIG. 4A. FIG. 4C is a view illustrating a change in film thickness of the upper protective layer caused by elution on the print head substrate of the conventional example. Incidentally, these figures schematically show the arrangement of each element of the print head substrate, and omit asperities of the film configuration or electrode wiring on the substrate as shown in FIG. 5 or the like. The same applies to FIGS. 6A and 6B according to the examples of the present invention and the following figures.

In the conventional example shown in these figures, an upper protective layer 107 as an electrode and a counter electrode 122 are made of the same material through the same process to generate an electrochemical reaction, and these electrodes are arranged in a planar direction. In this configuration, a voltage is applied across both electrodes with ink filled therebetween when removing kogation deposited on the surface of the upper protective layer 107 of a heating section 104*a* which is a part of the heating resistor, and the upper protective layer above the heating section is dissolved in the ink by an electrochemical reaction, thereby isolating and removing the kogation.

However, in the conventional example, as shown in FIG. 4B, a distance between the counter electrode 122 and the upper protective layer 107 relatively greatly varies depending on the portion of the upper protective layer 107. The size of the heating section 104*a* is set to 30 μm×30 μm, and the size of the upper protective layer 107 formed of iridium (hereinafter referred to as Ir) and acting as an electrode for removing kogation above the heating section 104*a* is set to 32.5 μm×32.5 μm. Incidentally, the heating section 104*a* is a part of the heating resistor, and FIG. 4B shows only a part of the heating section 104*a* and does not show other portions. In the above configuration, the counter electrode 122 is located at a distance 10 μm (=b) away from the upper protective layer 107 corresponding to an end of the heating section 104*a*. Further, when "a" denotes the longest distance and "b" denotes the shortest distance between the counter electrode 122 and a portion of the upper protective layer corresponding to the heating section 104*a*, the shortest distance "b" and the longest distance "a" are 10 μm and 40 μm, respectively. Accordingly, in the conventional example, the longest distance "a" is about quadruple the shortest distance "b," a ratio of which is relatively a large value. In this configuration, when kogation removing processing is performed by applying a voltage across the electrodes, a resistance between the electrodes via ink is lower at a portion with the shortest distance "b" from the counter electrode 122 rather than at a portion with the longest distance "a" from the counter electrode 122. Therefore, repeating the kogation removing processing faster decreases the film thickness of the electrode for removing kogation at the portion with the shortest distance "b" from the counter electrode 122, and as shown in FIG. 4C, a film thickness gradient occurs in the film thickness on the heating section 104*a*. If a distribution occurs in the film thickness of the protective layer above the heating section, when heat generated at the heating section is transferred to the ink, the heat conduction varies depending on the position of the protective layer, leading to a variation in foaming properties of ink at the heat acting portion.

In the present invention, a counter electrode is disposed such that a difference between the longest distance and the shortest distance between electrodes becomes small. More specifically, in a first embodiment of the present invention, a counter electrode is provided around a portion, in which an ejection port is formed, on a surface of a flow path forming member which faces the upper protective layer, so that a difference between the longest distance "a" and the shortest distance "b" between the upper protective layer and the counter electrode is reduced.

FIG. 5 is a cross-sectional view taken along line X-X' of FIG. 3 according to the first embodiment of the present invention. In FIG. 5, a heat accumulating layer 102 of a thermally-oxidized film, a SiO film, a SiN film, or the like is provided on a silicon base member 101. On the heat accumulating layer 102, a heat resistor layer 104, an electrode wiring layer 105 for supplying a current through the heat resistor layer, and a protective layer 106 for protecting these layers are formed. The electrode wiring layer 105 can be made of a metal material such as Al, Al—Si, or Al—Cu. The protective layer 106 is made of a SiO film, a SiN film, or the like and also functions as an insulating layer. A heating section 104*a* as an electrothermal transducer element is formed by partially removing the electrode wiring layer 105 formed on the heat resistor layer 104 so as to partially expose the heat resistor layer 104 corresponding to the removed portion. The electrode wiring layer 105 is connected to a driving element circuit or an external power supply terminal which are not shown in the figures and can receive power from the outside. Incidentally, in the example shown in FIG. 5, the electrode wiring layer 105 is disposed on the heating resistor layer 104, but it is possible to form the electrode wiring layer 105 on the base member 101, partially remove the electrode wiring layer 105 to form a gap, and dispose the heating resistor layer 104 on the electrode wiring layer 105.

An upper protective layer 107 as a protective film protects the heating section from chemical action by ink when a bubble is generated by heating of the heating section 104*a* and physical impact at the time of defoaming. Kogation may adhere to the surface of the protective layer as described above, and the protective layer acts as an electrode for removing the kogation. More specifically, the upper protective layer 107 is a layer eluted by an electrochemical reaction when the kogation is removed. In the present embodiment, for the upper protective layer 107 that contacts the ink, metal eluted by an electrochemical reaction in the ink, more specifically, iridium Ir, is used. Then, a portion 108 of the upper protective layer 107 located above the heating section 104*a* serves as a heat acting portion for causing heat generated by the heating section 104*a* to act on the ink. Incidentally, a contact layer 109 as an intermediate layer is provided between the upper protective layer 107 and the protective layer 106, thereby improving adhesion between these two layers. More specifically, tantalum Ta is used as the contact layer 109. The contact layer 109 forms a wiring portion for electrically connecting the upper protective layer 107 with an external terminal, and is made of a material having electrical conductivity. The contact layer 109 is inserted into a through hole (not shown) formed through the protective layer 106, and is connected to the electrode wiring layer 105. The end of the electrode wiring layer 105 acts as an external electrode for electrical connection with the external terminal. Accordingly, the upper protective layer 107 and the external terminal are electrically connected.

The print head substrate 1 is provided with the flow path forming member 120 made of an inorganic material such as SiN or $SiO_2$ forming an ink flow path and a liquid chamber with a silicon base. On the flow path forming member 120, the ejection port 121 is provided at a position opposite to the heat acting portion 108. In the present embodiment, the flow path forming member 120 is provided with the counter electrode 122 made of iridium Ir. More specifically, the counter electrode 122 is connected with counter electrode wiring 123 made of Ta disposed inside the flow path forming member 120, and is connected to an external power supply. To cover the counter electrode wiring 123, an electrode protective layer 126 made of SiN or $SiO_2$ is formed. The counter electrode wiring 123 has a function of improving adhesion between the flow path forming member 120 and the counter electrode. In the processing of removing kogation, the counter electrode 122 is used to produce a positive potential at the upper protective layer 107 and a negative potential at the counter electrode 122 by a control unit 505 provided for the ink jet printing apparatus, in a state in which the ink flow path and the liquid chamber are filled with ink, to generate an electrochemical reaction between the upper protective layer and the ink, so as to dissolve the upper protective layer. That is, the print head substrate of the present embodiment is provided with a counter electrode at a portion in a direction crossing the surface of the upper protective layer, and a configuration including an electrode for generating a potential difference between the counter electrode and the upper protective layer.

A description will be given of Examples 1-1 to 1-3 according to the present embodiment, in connection with the positional relation between the upper protective layer and the counter electrode and the resulting uniformity of a dissolution amount of the upper protective layer, in comparison with Comparative Examples 1 and 2.

Example 1-1

Figure 6A:
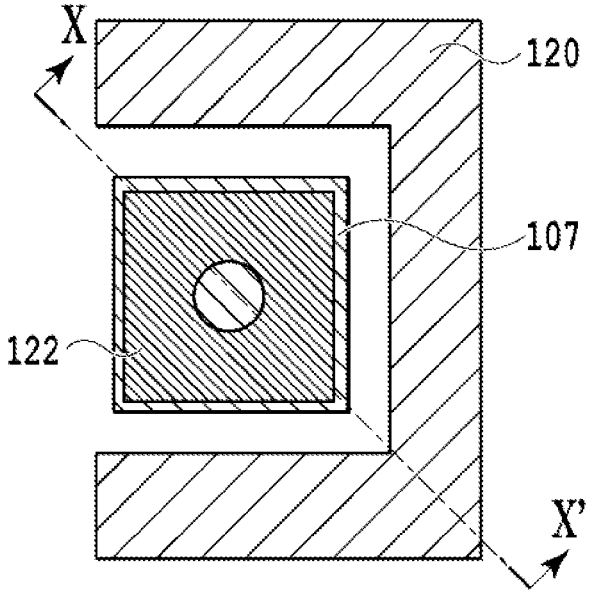
FIG. 6A is a cross-sectional view of the vicinity of a heat acting portion corresponding to one ejection port of the print head substrate, as viewed from the ejection port, according to Example 1-1 of the first embodiment.
Figure 6B:
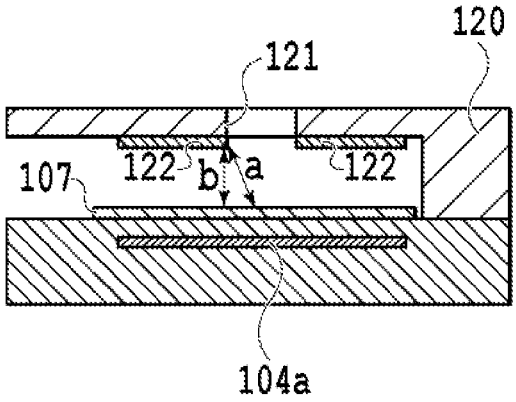
FIG. 6B is a cross-sectional view taken along line X-X' of FIG. 6A.

FIG. 6A is a cross-sectional view of the vicinity of the heat acting portion corresponding to one ejection port of the print head substrate, as viewed from the ejection port, according to Example 1-1, and in particular shows the positional relation between the upper protective layer and the counter electrode. That is, FIG. 6A shows the counter electrode 122 provided at the back side of the flow path forming member 120 in an overlapping manner so as to express the positional relation. The counter electrode is shown in an overlapping manner also in the similar cross-sectional views in the following description. FIG. 6B is a cross-sectional view taken along line X-X' of FIG. 6A.

As shown in these figures, in the present example, the heating section 104*a* has a size of 30 μm×30 μm, and an insulating protective layer having a thickness of 200 to 300 nm is formed on the heating section. Further, on the insulating protective layer, a contact layer of Ta having a thickness of 100 nm is formed. The upper protective layer 107 is formed to have a thickness of 100 nm, above the heating section via the above-mentioned films. The size of the upper protective layer is 32.5 μm×32.5 μm and the upper protective layer is patterned in a square. Above these films and layers, the flow path forming member 120 is provided. The flow path forming member is made of an inorganic material such as SiN or $SiO_2$ and has a thickness of 3 μm in a vertical direction in the figures, and a liquid chamber for foaming ink is defined by the flow path forming member. The flow path and the liquid chamber have a height of 7 μm and are provided with an ejection port having a diameter of 10 μm above the heat acting portion.

In the present example, the counter electrode 122 is provided on the flow path forming member 120 inside the liquid chamber as shown in FIG. 6B. The counter electrode 122 is a square having a size of 30 μm×30 μm, which is the same size as that of the heating section 104*a*, and a portion corresponding to the ejection port is opened. In the present example, a maximum value "a" of the distance between the electrodes is, as shown in FIG. 6B, a distance between the center of the upper protective layer 107 and an end of the ejection port, which is 8.6 μm. Meanwhile, a minimum value "b" is 7 μm, which is equal to the height of the flow path. The terms "maximum value" and "minimum value" as used herein are defined as follows. As viewed from the area of the upper protective layer 107 overlapping with the heating section 104*a*, the distances between the upper protective layer 107 and the closest positions on the counter electrode 122 are determined. In these distances, the longest distance is the "maximum value" and the shortest distance is the "minimum value." The same applies also to the following description.

Example 1-2

Figure 7A:
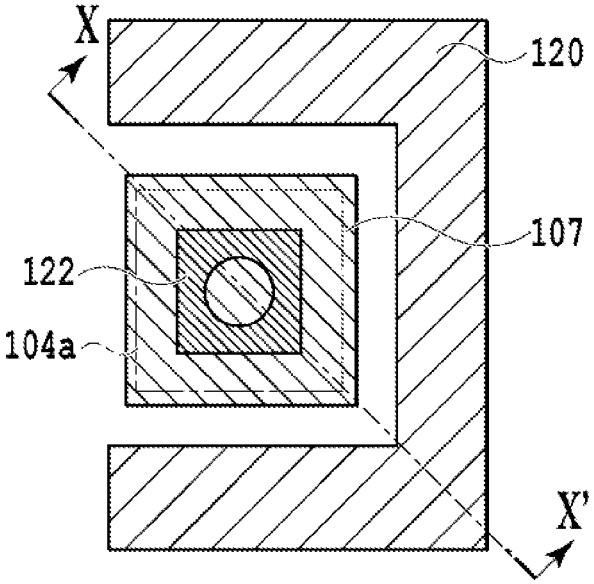
FIGS. 7A and 7B are views respectively corresponding to FIGS. 6A and 6B according to Example 1-2 of the first embodiment.
Figure 7B:
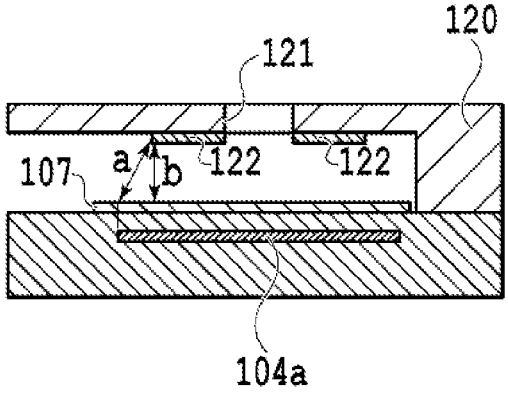

FIGS. 7A and 7B are views respectively corresponding to FIGS. 6A and 6B according to the above Example 1-1. In Example 1-2, like Example 1-1, the counter electrode 122 is provided on the flow path forming member 120 inside the liquid chamber as shown in FIG. 7A. The difference is that the size of the counter electrode 122 is 18.5 μm×18.5 μm, which is smaller as compared to Example 1-1.

In Example 1-2, the maximum value "a" between the upper protective layer and the counter electrode is, as shown in FIG. 7B, the distance between a portion on the upper protective layer 107 corresponding to an end portion of the heating section 104*a* and an end portion of the counter electrode 122, and is 10.7 μm. Meanwhile, the minimum value "b" is 7 μm, which is equal to the height of the flow path.

Example 1-3

Figure 8A:
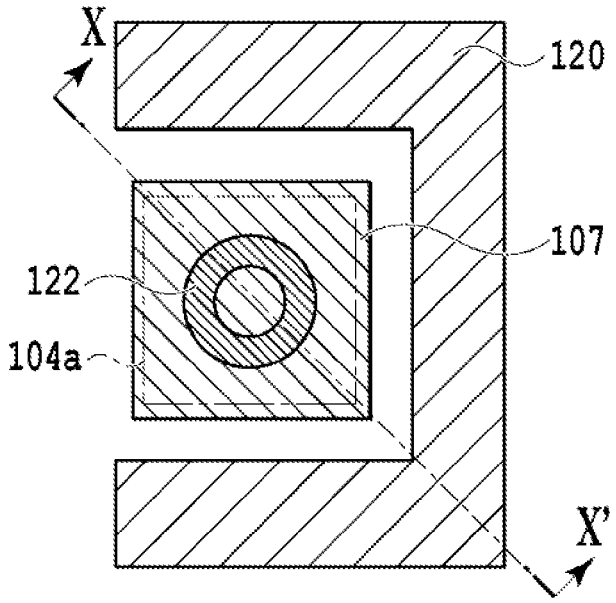
FIGS. 8A and 8B are views respectively corresponding to FIGS. 6A and 6B according to Example 1-3 of the first embodiment.
Figure 8B:
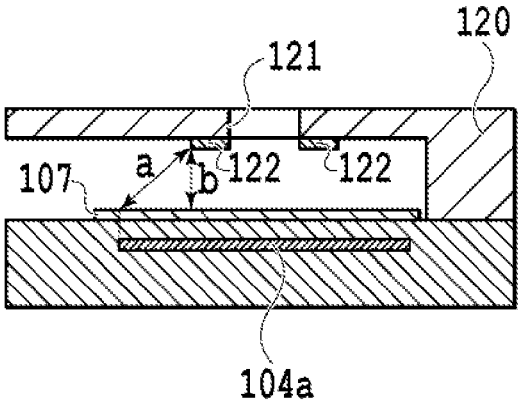

FIGS. 8A and 8B are views respectively corresponding to FIGS. 6A and 6B according to Example 1-1. In Example 1-3, like Example 1-1, the counter electrode 122 is provided on the flow path forming member 120 inside the liquid chamber as shown in FIG. 8A. The difference is that the counter electrode 122 has a circular form having a diameter of 18.2 μm.

In Example 1-3, the maximum value "a" between the upper protective layer and the counter electrode is, as shown in FIG. 8B, the distance between a portion on the upper protective layer 107 corresponding to an end portion of the heating section 104*a* and an end portion of the counter electrode 122, and is 14 μm. Meanwhile, the minimum value "b" is 7 μm, which is equal to the height of the flow path.

Comparative Example 1

Figure 9A:
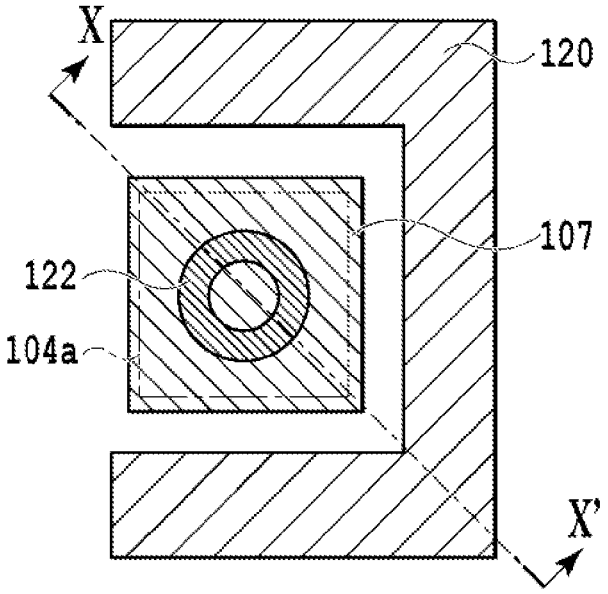
FIGS. 9A and 9B are views respectively corresponding to FIGS. 6A and 6B according to comparative examples.
Figure 9B:
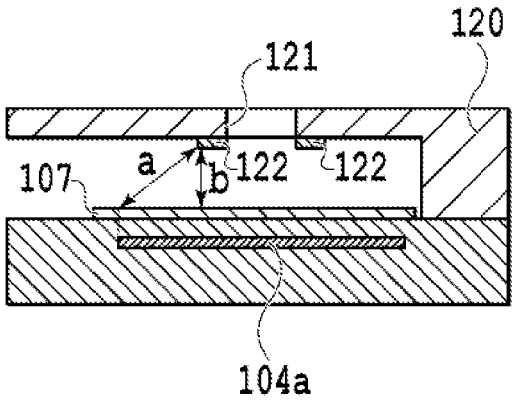

FIGS. 9A and 9B are views respectively corresponding to FIGS. 6A and 6B according to the above Example 1-1. In Comparative Example 1, like Example 1-1, the counter electrode 122 is provided on the flow path forming member 120 inside the liquid chamber as shown in FIG. 9A.

In the present comparative example, the counter electrode has a circular form having a diameter of 16.6 μm, in which an area of the ejection port having a diameter of 10 μm is opened. In Comparative Example 1, the maximum value "a" between the upper protective layer and the counter electrode is the distance between a portion on the upper protective layer corresponding to an end portion of the heating section 104*a* and an end portion of the counter electrode, as shown in FIG. 9B, and is 14.7 μm. Meanwhile, the minimum value "b" is 7 μm, which is equal to the height of the flow path.

Comparative Example 2

Comparative Example 2 is the conventional configuration disclosed in Japanese Patent Laid-Open No. 2008-105364 and, as shown in FIG. 4B, the counter electrode is located in parallel with the upper protective layer on the substrate. In Comparative Example 2, as described above, the maximum value "a" between the upper protective layer and the counter electrode is 40 μm. Meanwhile, the minimum value "b" is 10 μm.

By using the print head according to Examples 1-1 to 1-3 and Comparative Examples 1 and 2 as described above, a dissolution amount of the upper protective layer is studied. In this study, the ink liquid chamber is filled with pigment ink, and a voltage of 10 V and a voltage of −10 V are applied to the upper protective layer and the counter electrode, respectively, for 60 seconds. A decrease in the thickness of the upper protective layer (film reduction amount) is obtained, and a maximum value and a minimum value of the film reduction amount are obtained. The results are shown in Table 1.

TABLE 1

Relation between interelectrode distance and uniformity of film reduction amount

| | a. Maximum distance | b. Minimum distance | a/b | Uniformity of film reduction amount |
|---|---|---|---|---|
| Example 1-1 | 8.6 μm | 7 μm | 1.2 | ○ |
| Example 1-2 | 10.7 μm | 7 μm | 1.5 | ○ |
| Example 1-3 | 14 μm | 7 μm | 2.0 | ○ |
| Comparative Example 1 | 14.7 μm | 7 μm | 2.1 | Δ |
| Comparative Example 2 | 40 μm | 10 μm | 4.0 | Δ |

In Table 1, uniformity of the film reduction amount resulting from dissolution of iridium which forms a protective layer is denoted by "○," "Δ" and "×" respectively when the value obtained by dividing the maximum value of the film reduction amount by the minimum value of the film reduction amount is equal to or less than 2, when the value is equal to or greater than 2 and equal to or less than 5, and when the value is equal to or greater than 5.

As can be seen from Table 1, in Example 1-1 in which the difference between the maximum distance "a" and the minimum distance "b" is small, that is, when a ratio a/b is small, a difference in the film reduction amount on the upper protective layer is little. In Examples 1-2 and 1-3, as a difference between the distances increases, that is, as a ratio between the distances increases, uniformity of the film reduction amount gradually decreases, and as a difference between the distances increases as in Comparative Examples 1 and 2, a difference in the film reduction amount exceeds two times.

The smaller the ratio of the maximum distance "a" to the minimum distance "b," the more uniformly the upper protective layer dissolves. It is considered that this is because the smaller the ratio, the more uniform the electric field strength. In view of Table 1, in a case where potentials are produced between the upper protective layer and the counter electrode to dissolve the upper protective layer, when a ratio a/b between the distances has the relation of $1<a/b\leq 2$, the dissolution amount of the upper protective layer satisfies a maximum film reduction amount/minimum film reduction amount $\leq 2$. Accordingly, the upper protective layer is dissolved more uniformly.

Second Embodiment

A second embodiment of the present invention is to reduce a difference between a maximum distance "a" and a minimum distance "b" regarding the distance between an upper protective layer and a counter electrode, by providing a step portion on a base member of a print head substrate and providing a counter electrode on the step.

Figure 10:
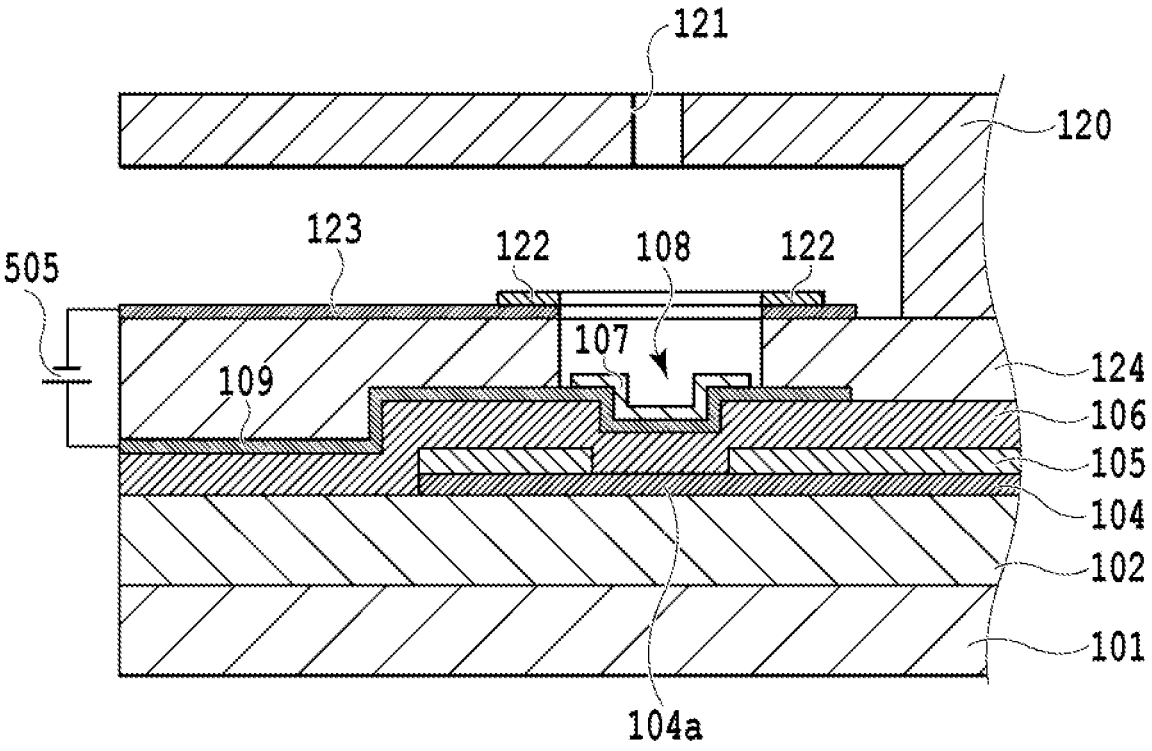
FIG. 10 is a cross-sectional view, corresponding to FIG. 5, of the vicinity of a heat acting portion of a print head substrate according to a second embodiment of the present invention.

FIG. 10 is a cross-sectional view, corresponding to FIG. 5, of the vicinity of the heat acting portion of the print head substrate according to the second embodiment of the present invention. Note that in the present embodiment, an apparatus and a print head that are similar to the ink jet printing apparatus shown in FIG. 1 according to the first embodiment and the print head shown in FIGS. 2 and 3 are used. In FIG. 10, a difference between the configuration according to the present embodiment and the configuration shown in FIG. 5 according to the first embodiment is that by using an SOG process, an interlayer film 124 is formed by applying inorganic material such as SiN or $SiO_2$ around a heat acting portion 108 to form a step by the interlayer film. Then, on the interlayer film 124, counter electrode wiring 123 made of tantalum Ta and a counter electrode 122 made of iridium Ir are formed. The counter electrode 122 is connected with the counter electrode wiring 123, so as to be connected with an external power supply. Incidentally, the counter electrode wiring 123 has a function of improving adhesion between the interlayer film 124 and the counter electrode 122.

Also in the present embodiment, after a liquid chamber is filled with ink, a positive potential is produced at an upper protective layer 107 and a negative potential is produced at the counter electrode 122 to generate an electrochemical reaction, thereby dissolving a surface of the upper protective layer. This processing allows removal of kogation generated on the surface of the upper protective layer.

A description will be given of Examples 2-1 and 2-2 according to the present embodiment in connection with the positional relation between the upper protective layer and the counter electrode and uniformity of the dissolution amount of the upper protective layer.

Example 2-1

Figure 11A:
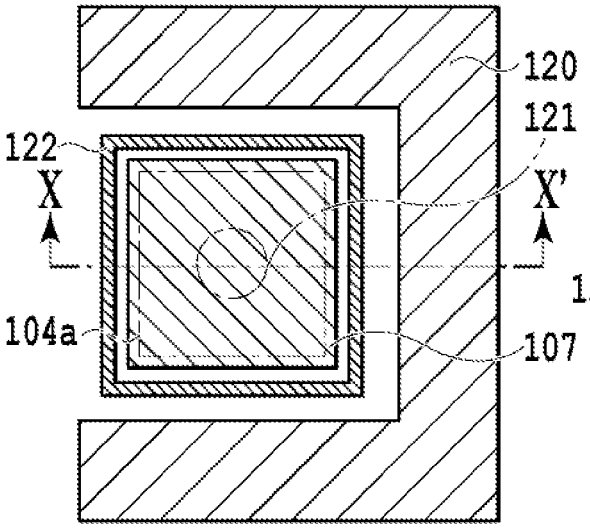
FIG. 11A is a top view showing the positional relation between an upper protective layer and a counter electrode, as viewed from the top of an ejection port, according to Example 2-1 of the second embodiment.
Figure 11B:
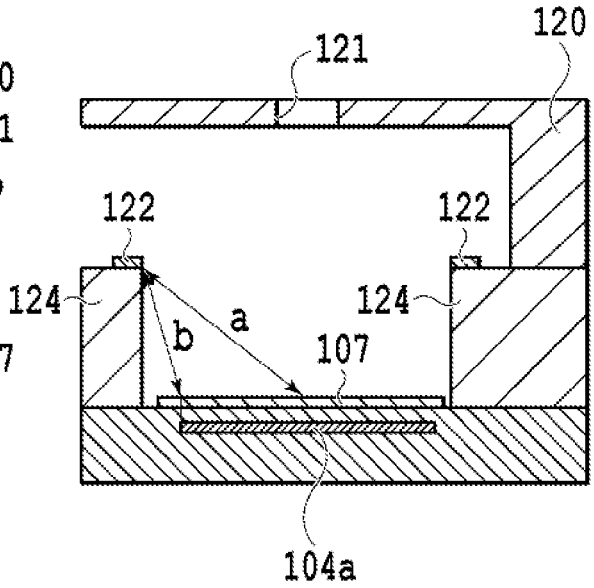
FIG. 11B is a cross-sectional view of the vicinity of a heat acting portion taken along line X-X' of FIG. 11A.

FIG. 11A is a top view showing the positional relation between the upper protective layer and the counter electrode, as viewed from the top of an ejection port, according to Example 2-1. FIG. 11B is a cross-sectional view of the vicinity of the heat acting portion taken along line X-X' of FIG. 11A.

In the present example, a heating section 104*a* is a square having a size of 30 μm×30 μm, and an insulating protective layer having a thickness of 200 to 300 nm is formed on the heating section. Further, on the insulating protective layer, a contact layer of tantalum Ta having a thickness of 100 nm is formed. The upper protective layer 107 is formed to have a thickness of 100 nm above these layers to cover the heating section 104*a*, thus forming the heat acting portion 108 (see FIG. 10). The upper protective layer 107 is a square having a size of 32.5 μm×32.5 μm. The interlayer 124 having a height of 30 μm is formed around the heat acting portion. Incidentally, as shown in FIG. 11B, the interlayer 124 is formed 1 μm outside the upper protective layer 107. Further, a layer of the counter electrode 122 (and the counter electrode wiring) has a thickness of 100 nm. Meanwhile, above the heat acting portion (heating section 104*a*) in a liquid chamber for foaming ink in a flow path forming member 120, an ejection port 121 having a diameter of 10 μm is formed.

In Example 2-1, as shown in FIG. 11B, the counter electrode 122 is provided on the interlayer film 124. The height of the interlayer film 124 on which the counter electrode 122 is provided is 30.1 μm. In the present example, a maximum value "a" of the distance between the upper protective layer 107 and the counter electrode 122 is, as shown in FIG. 11B, the distance between the center of the upper protective layer 107 and an end portion of the counter electrode 122, and is 34.6 μm. Meanwhile, a minimum value "b" is the distance between a position on the upper protective layer 107 corresponding to an end of the heating section 104*a* and an end portion of the counter electrode 122, and is 30.1 μm.

Example 2-2

Figure 12:
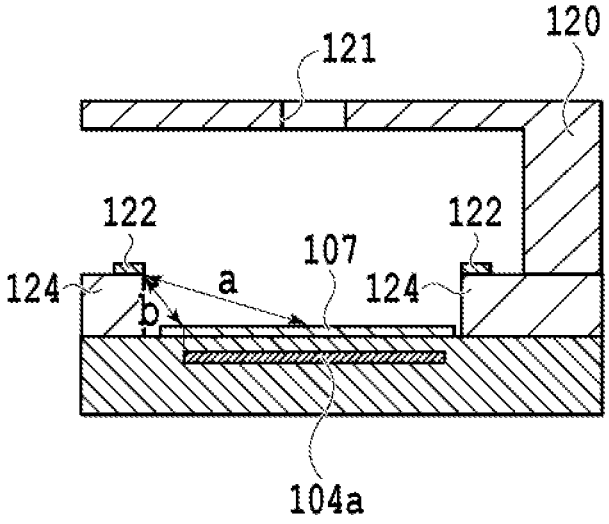
FIG. 12 is a cross-sectional view, corresponding to FIG. 11B, according to Example 2-2 of the second embodiment.

FIG. 12 is a cross-sectional view, corresponding to FIG. 11B, according to the present example. As shown in FIG. 12, in Example 2-2, like Example 2-1, a counter electrode is provided on the interlayer film 124 inside a liquid chamber. The height of the interlayer film 124 on which the counter electrode 122 is provided is 9.5 μm. In Example 2-2, a maximum value "a" of the distance between the upper protective layer 107 and the counter electrode 122 is the distance between the center of the upper protective layer 107 and an end portion of the counter electrode 122, and is 19.7 μm. Meanwhile, a minimum value "b" is the distance between a position on the upper protective layer 107 corresponding to an end of the heating section 104*a* and an end portion of the counter electrode 122, and is 9.7 μm.

Comparative Example 3

Figure 13:
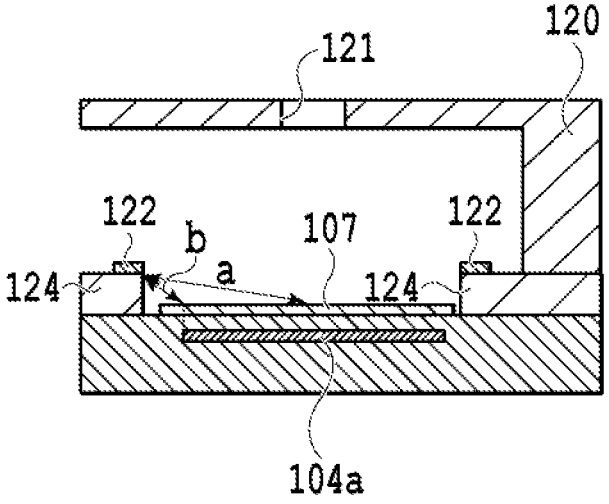
FIG. 13 is a cross-sectional view, corresponding to FIG. 11B, according to a comparative example.

FIG. 13 is a cross-sectional view, corresponding to FIG. 11B, according to the present comparative example. In the configuration according to Comparative Example 3, like Example 1-1, a counter electrode is provided on the interlayer film 124 inside a liquid chamber. The height of the interlayer film 124 on which the counter electrode 122 is provided is 8.5 μm. In the present Comparative Example 3, a maximum value "a" of the distance between the upper protective layer 107 and the counter electrode 122 is the distance between the center of the upper protective layer 107 and an end portion of the counter electrode 122, and is 19.2 μm. Meanwhile, a minimum value "b" is the distance between a position on the upper protective layer 107 corresponding to an end of the heating section 104*a* and an end portion of the counter electrode 122, and is 8.8 μm.

By using the print head according to Examples 2-1 and 2-2 and Comparative Example 3 as described above, a dissolution amount of the upper protective layer is studied. In this study, the ink liquid chamber is filled with pigment ink, and a voltage of 10 V and a voltage of −10 V are applied at the upper protective layer 107 and the counter electrode 122, respectively, for 60 seconds. A decrease in the film reduction amount of each part on the surface of the upper protective layer 107 is obtained, and a maximum value and a minimum value of the film reduction amount are obtained. The results are shown in Table 2.

TABLE 2

Relation between interelectrode distance and uniformity of film reduction amount

| | a. Maximum distance | b. Minimum distance | a/b | Uniformity of film reduction amount |
|---|---|---|---|---|
| Example 2-1 | 34.6 μm | 30.1 μm | 1.15 | ○ |
| Example 2-2 | 19.7 μm | 9.7 μm | 2.0 | ○ |
| Comparative Example 3 | 19.2 μm | 8.8 μm | 2.2 | Δ |

In Table 2, uniformity of the film reduction amount resulting from dissolution of iridium Ir is denoted by "○," "Δ," and "×" respectively when the value obtained by dividing the maximum value of the film reduction amount by the minimum value of the film reduction amount is equal to or less than 2, when the value is equal to or greater than 2 and equal to or less than 5, and when the value is equal to or greater than 5.

As can be seen from Table 2, in Example 2-1 in which the difference between the maximum distance and the minimum distance is small, a difference in the film reduction amount among the parts of the upper protective layer is little. However, as the difference between the distances increases, uniformity of the film reduction amount gradually decreases, and as a difference between the distances increases as in Comparative Example 3, a difference in the film reduction amount exceeds two times. In this manner, also in the present embodiment, the smaller the ratio of the maximum value "a" of the distance to the minimum value "b" of the distance, the more uniformly the upper protective layer dissolves. That is, when a ratio a/b between the distances (between the upper protective layer and the counter electrode) has the relation of $a/b \leq 2$, the dissolution amount of the upper protective layer satisfies a maximum film reduction amount/minimum film reduction amount ≤2. Accordingly, the upper protective layer is dissolved more uniformly.

(Manufacturing Method of the Exemplary Print Head Substrate)

FIGS. 14A to 14E and FIGS. 15A to 15D show a manufacturing method of the print head substrate of the above-mentioned Example 2-1. These figures show cross-sectional views corresponding to FIG. 5.

Figure 14A:
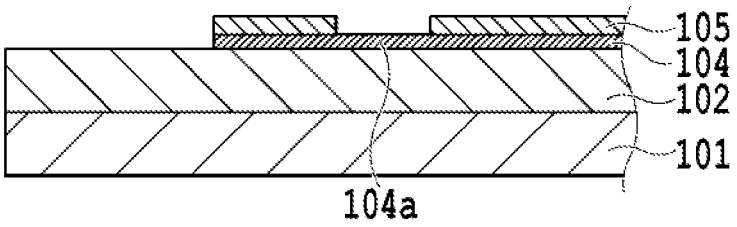
FIGS. 14A to 14E are views showing a manufacturing method of the print head substrate of the above-mentioned Example 2-1.

First, as shown in FIG. 14A, a heat accumulating layer 102 of a thermally-oxidized film or a SiO film is provided on a silicon base member 101 on which a driving element circuit is formed, by using a CVD process. On the heat accumulating layer, a heat resistor layer 104 and an electrode wiring layer made of Al—Cu are deposited by sputtering. A heating section 104*a* is formed by partially removing an electrode wiring layer 105 to form a gap and partially exposing the heat resistor layer 104 corresponding to the removed portion. Incidentally, in the example shown in the figures, the electrode wiring layer 105 is provided on the heat resistor layer 104. Further, it is also possible to form the electrode wiring layer 105 on the base member 101, and the electrode wiring layer 105 is partially removed to form a gap, so as to form the heat resistor layer 104.

Figure 14B:
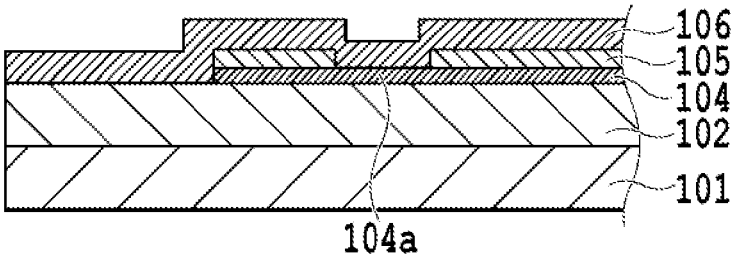

Next, as shown in FIG. 14B, to cover the heating section 104*a* and the electrode wiring layer 105, a plasma CVD process is used to form an insulating layer 106 of a SiN film to have a thickness of 300 nm. Next, a contact layer 109 made of tantalum Ta is formed to have a thickness of 100 nm and an upper protective layer made of iridium Ir is formed to have a thickness of 100 nm by sputtering.

Figure 14C:
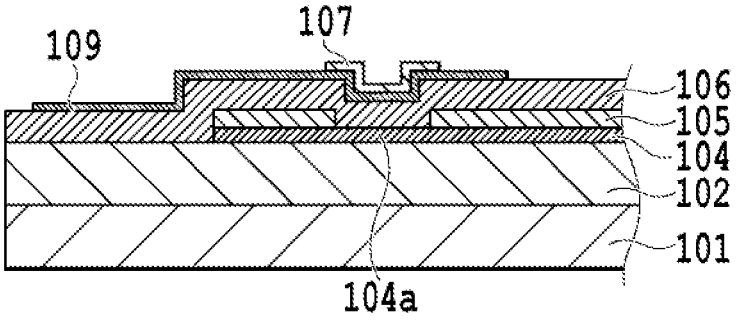

Next, iridium Ir forming the upper protective layer 107 is patterned so as to be left on the heating section, and then the contact layer 109 made of tantalum Ta is patterned. Incidentally, the contact layer 109 made of tantalum Ta acts as wiring for supplying power to the upper protective layer 107 acting as an electrode for removing kogation (FIG. 14C).

Figure 14D:
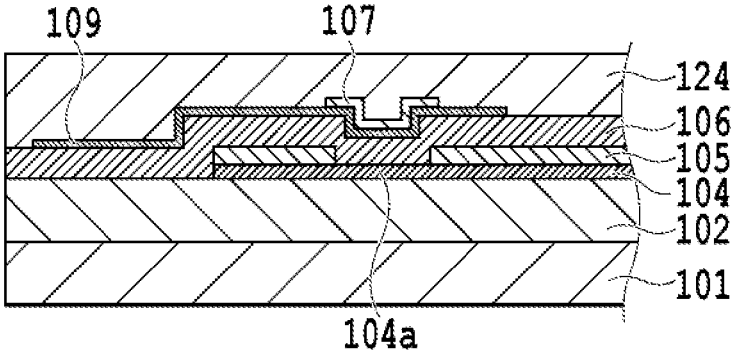
Figure 14E:
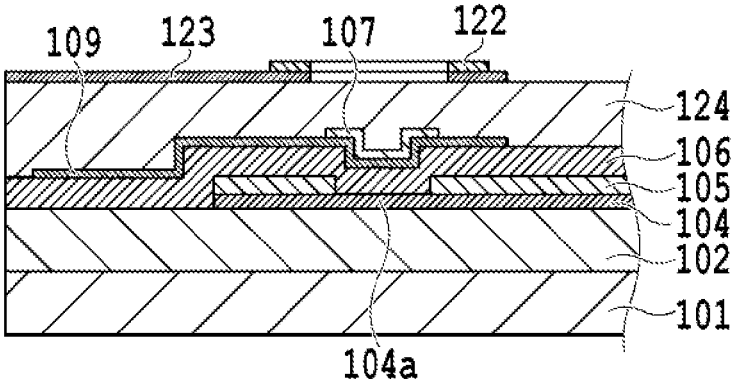

Next, as shown in FIG. 14D, an interlayer film 124 is formed to have a thickness of 30 μm so as to cover the upper protective layer 107 and the contact layer 109 by using an SOG process. Then, as shown in FIG. 14E, counter electrode wiring 123 made of tantalum Ta and a counter electrode 122 made of iridium Ir, each having a thickness of 100 nm, are formed by sputtering. After patterning the counter electrode 122, the counter electrode wiring 123 is patterned.

Figure 15A:
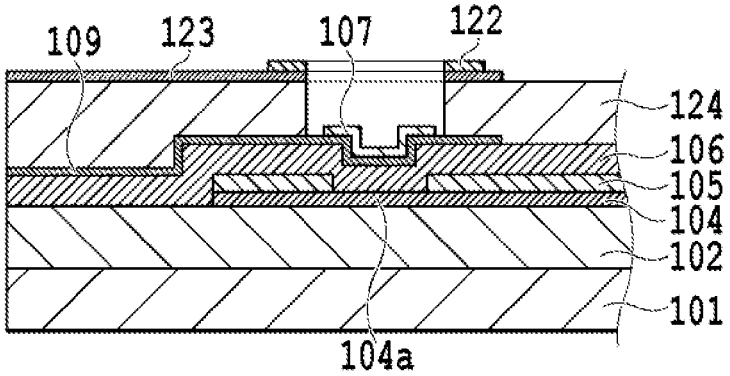
FIGS. 15A to 15D are views similarly showing a manufacturing method of the print head substrate of the above-mentioned Example 2-1.
Figure 15B:
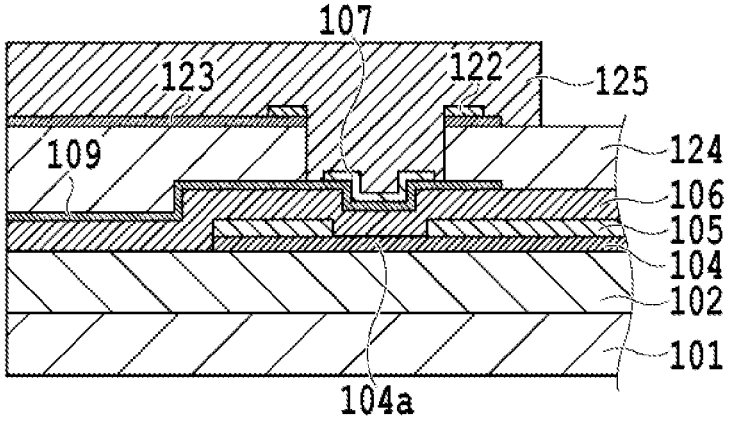

Next, as shown in FIG. 15A, the interlayer film 124 formed in the process shown in FIG. 14D is dry etched by using a mixed gas of CF4 and O2. Then, as shown in FIG. 15B, a molding material 125 for forming a flow path forming member 120 for forming an ejection port for ejecting ink droplets and an ink flow path is applied to have a predetermined thickness by spin coating, and thereafter, the flow path is patterned. A positive photoresist is used as the molding material 125, applied by spin coating, and baked on a hot plate at a temperature of 120° C. for six minutes to form the molding material 125.

Figure 15C:
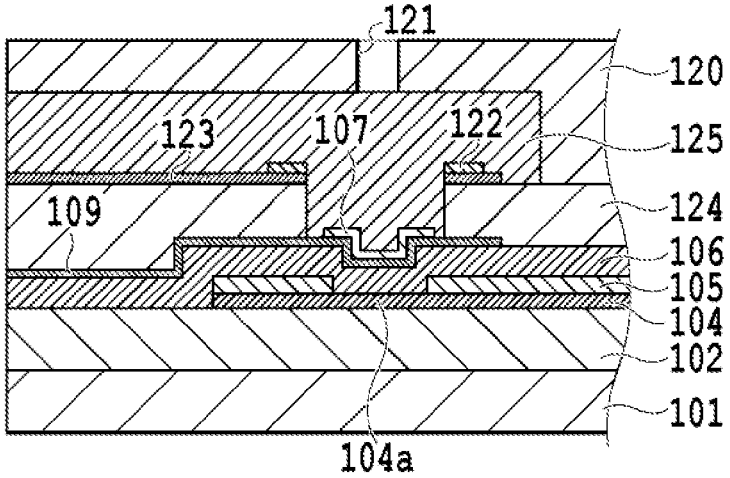

Then, as shown in FIG. 15C, a negative photoresist is used as the flow path forming member 120, applied by spin coating, and baked on a hot plate at a temperature of 90° C. for five minutes to form the flow path forming member 120. Thereafter, the flow path forming member 120 is exposed and developed by using an i-line stepper to form the flow path forming member 120 and an ejection port 121 at a time.

Figure 15D:
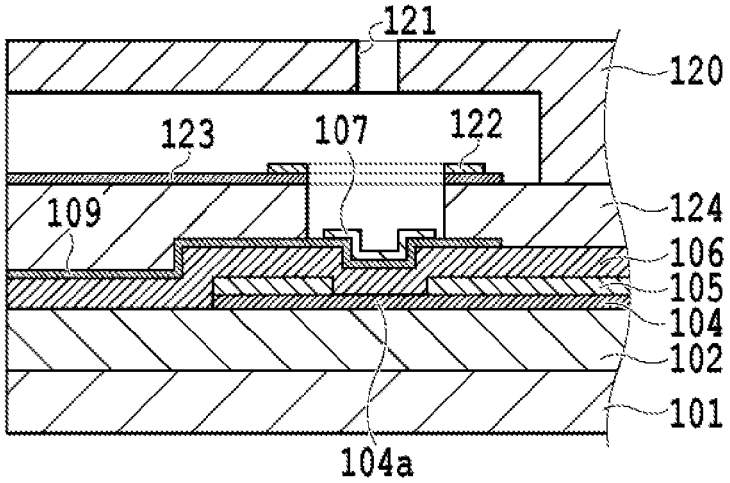

Then, after forming an ink supply port, as shown in FIG. 15D, the positive photoresist forming the molding material 125 is immersed in methyl lactate which is heated to a temperature of about 40° C., and the molding material 125 is removed by dissolution at a time. A photosensitive resin material is completely cured in an oven at a temperature of 200° C., and a print head substrate (FIG. 10) is molded.

Third Embodiment

In a third embodiment of the present invention, a difference between a longest distance "a" and a shortest distance "b" between an upper protective layer and a counter electrode is reduced by providing a counter electrode on a side wall portion or the like of a supply port for supplying ink to a heat acting portion with an ejection energy generating element on a print head substrate.

Figure 16:
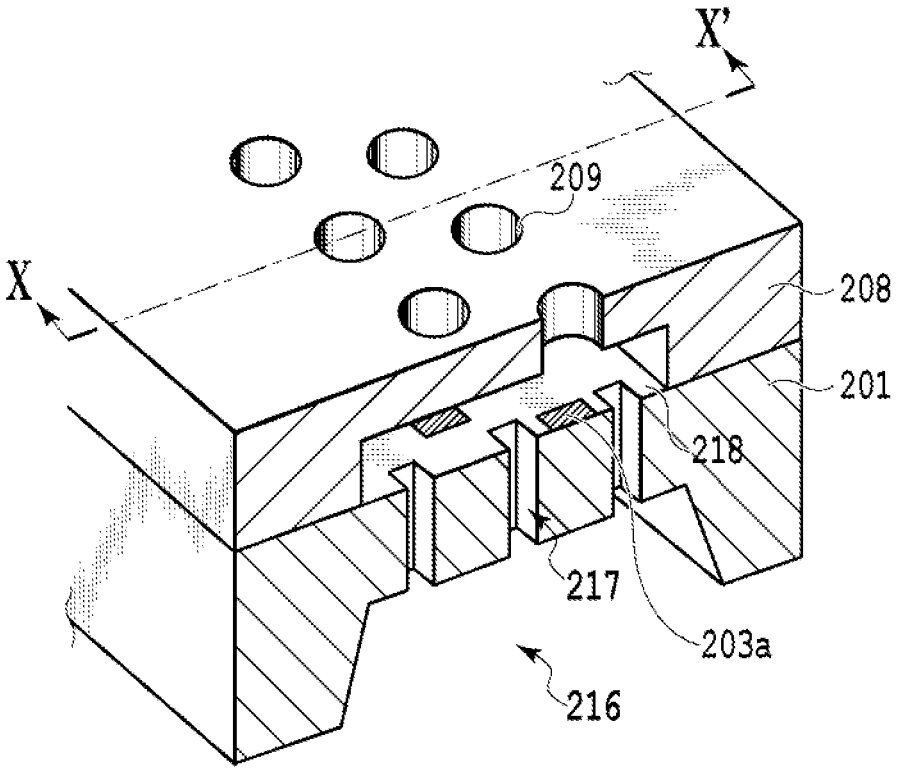
FIG. 16 is a perspective view of a cross section of a part of a print head substrate according to a third embodiment of the present invention.

FIG. 16 is a perspective view of a cross section of a part of a print head substrate according to the third embodiment of the present invention. Regarding the substrate, a plurality of ejection energy generating elements (heating sections) 203*a* for generating a bubble in ink, a driving circuit for driving the ejection energy generating elements, and others are formed on a silicon substrate 201 by using semiconductor manufacturing techniques. On the substrate 201 on which the ejection energy generating elements and others are formed, a flow path forming member 208 is provided, so that an ejection port 209 and an ink flow path 218 are provided corresponding to each of the ejection energy generating elements 203*a*. Further, on a side of the substrate 201 opposite to the surface on which the ejection energy generating elements and others are formed, a common liquid supply port 216 for supplying ink to be supplied to each of the ejection energy generating elements is formed. Furthermore, a liquid supply port 217 penetrating from the common liquid supply port to the surface of the substrate 201 is formed corresponding to each of the ejection energy generating elements. In ink supplied to each ink flow path 218 via the common liquid supply port 216 and the liquid supply port 217, a bubble is formed with heat generated by the ejection energy generating element 203*a*, and the resulting pressure causes the ink to be ejected from the ejection port 209.

Figure 17:
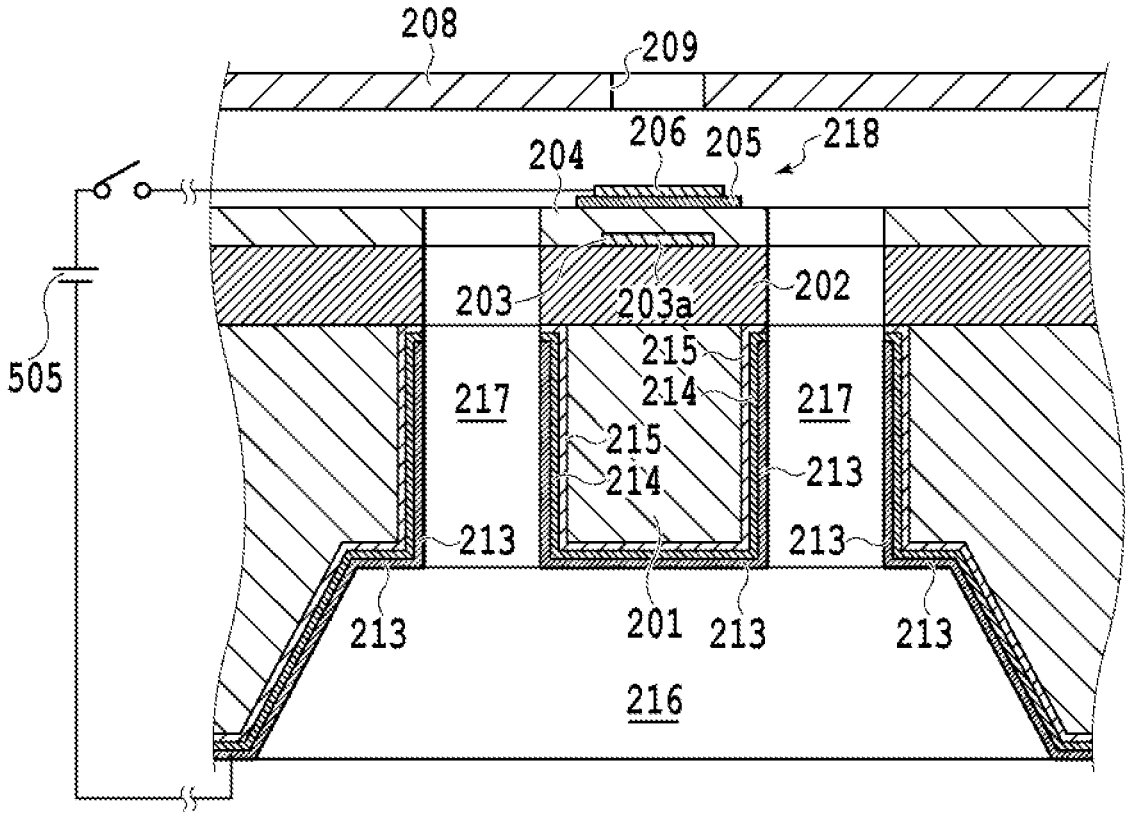
FIG. 17 is a cross-sectional view of the vicinity of a heat acting portion taken along line X-X' of FIG. 16.

FIG. 17 is a cross-sectional view of the vicinity of the heat acting portion taken along line X-X' of FIG. 16. FIG. 17 shows the silicon substrate 201, a heat accumulating layer 202 of a thermally-oxidized film, a SiO film, a SiN film, or the like, and a heating resistor layer 203. The heating section 203*a* is formed by exposing the heating resistor layer 203. Further, an electrode wiring layer (not shown) acts as wiring made of a metal material such as Al, Al—Si, or Al—Cu, and is connected to a driving element circuit and an external power supply terminal so as to receive power from the outside. A protective layer 204 is provided on the heat acting portion and the electrode wiring layer. The protective layer 204 also functions as an insulating layer made of a SiO film, a SiN film, or the like. An upper protective layer 206 protects an electrothermal transducer element (heating section) from chemical change due to heating of the heating section 203*a* and physical impact at the time of defoaming above the heating section 203*a*. Kogation may adhere to the upper protective layer 206 by the chemical change or the like. The upper protective layer 206 is a layer acting as an electrode in the processing of removing kogation and being eluted by an electrochemical reaction when voltage is applied to the electrode. In the present embodiment, for the upper protective layer 206 that contacts the ink, metal eluted by an electrochemical reaction in the ink, more specifically, iridium Ir, is used. A portion formed in the above manner in which the heating section 203*a* and the upper protective layer 206 overlap serves as a heat acting portion for causing heat generated by the heating section 203*a* to act on the ink. Incidentally, a contact layer 205 is provided between the insulating protective layer 204 and the upper protective layer 206, thereby improving adhesion to the insulating protective layer 204. The contact layer 205 forms a wiring portion for electrically connecting the upper protective layer 206 with an external terminal, and is made of a material having electrical conductivity. The contact layer 205 is inserted into a through hole formed through the insulating protective layer 204, and is connected to the electrode wiring layer (not shown). An end of the electrode wiring layer acts as an external electrode (not shown) for electrical connection with the external terminal. Accordingly, the upper protective layer 206 and the external terminal are electrically connected.

Figure 19:
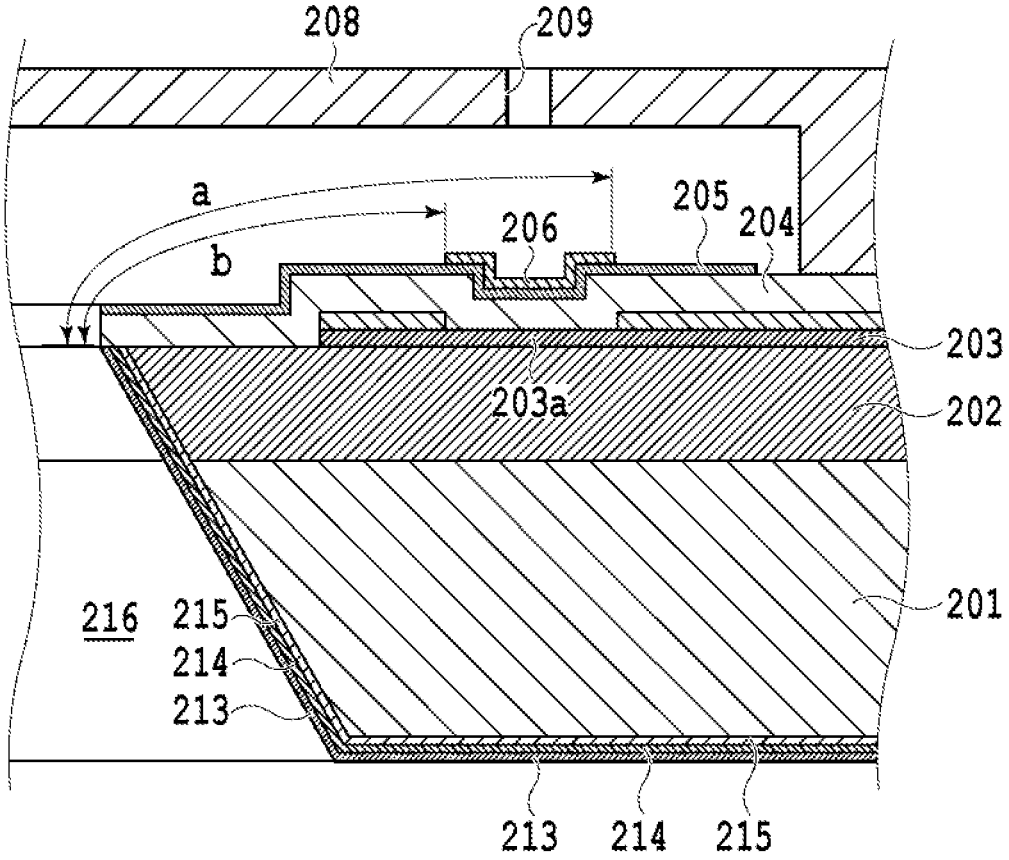
FIG. 19 is a cross-sectional view of the vicinity of a heat acting portion of a print head substrate according to Example 3-2 of the third embodiment.

In the present embodiment, regarding the arrangement of a counter electrode used for removing kogation, Example 3-1 shows the case of providing a counter electrode on each of the common liquid supply port 216 and the liquid supply port 217 whose shapes are formed by wet etching and dry etching as shown in FIG. 17. Example 3-2 shows the case of providing a counter electrode on the common liquid supply port 216 formed by wet etching as shown in FIG. 19.

In the present embodiment, on a wall portion defining the common liquid supply port 216 and the liquid supply port 217, a counter electrode contact layer 214 made of tantalum Ta and a counter electrode 213 made of iridium Ir are formed. The counter electrode 213 is connected to the counter electrode contact layer 214, and to the external power supply. Incidentally, Ir used for the counter electrode 213 is a noble metal having excellent chemical resistance, and is insoluble in alkaline or acid. Therefore, in a case where the back side contacts ink, the counter electrode 213 may be arranged to the back side of the substrate as a protection against corrosion of the silicon substrate due to ink. Further, on the substrate 201 on which the above layers are formed, the flow path forming member 208 is formed. On the flow path forming member 208, the ejection port 209 is formed at a position corresponding to the heat acting portion (heating section 203*a*).

In the processing of removing kogation, after a liquid chamber including the heat acting portion is filled with ink, a positive potential is produced at the upper protective layer 206 and a negative potential is produced at the counter electrode 213 to generate an electrochemical reaction. Accordingly, a surface of the upper protective layer 206 is dissolved and kogation adhering to the surface is removed.

A description will be given of the following examples and comparative example in connection with the positional relation between the upper protective layer 206 and the counter electrode 213 and uniformity of the dissolution of the upper protective layer.

Example 3-1

An ink supply port of Example 3-1 is configured to include the common liquid supply port 216 and the plurality of liquid supply ports 217 which are in communication with the common liquid supply port. The counter electrode 213 used for removing kogation is provided on a wall portion defining the common liquid supply port 216 and each of the plurality of liquid supply ports 217.

Figure 18A:
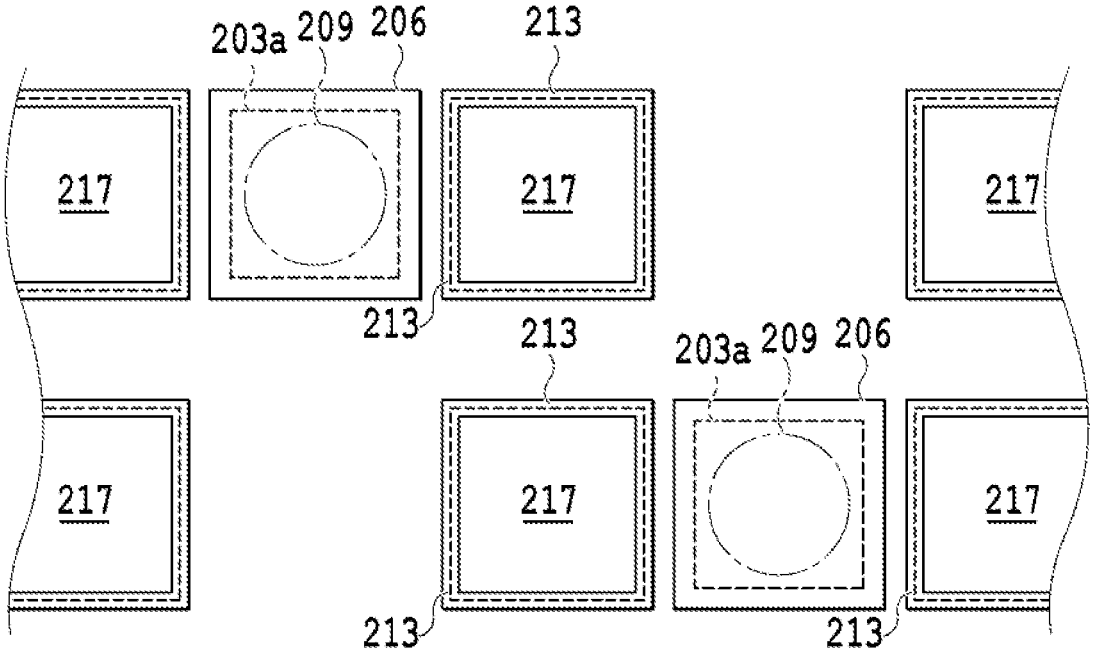
FIG. 18A is a top view of a print head substrate as viewed from the top of an ejection port, according to Example 3-1 of the third embodiment.

FIG. 18A is a top view of a print head substrate of the present example, as viewed from the top of an ejection port, and in particular shows the positional relation between the upper protective layer 206 and the counter electrode 213. Further, FIG. 18B is a cross-sectional view of the vicinity of the heat acting portion taken along line X-X' of FIG. 18A.

In the present example, the heating section 203*a* has a size of 15 μm×15 μm, and the insulating protective layer 204 having a thickness of 200 to 300 nm is formed on the heating section 203*a*. On the insulating protective layer 204, the contact layer 205 made of tantalum Ta is formed to have a thickness of 100 nm, and the upper protective layer 206 made of iridium Ir is formed thereon to have a thickness of 100 nm to cover the heating section 203*a*. The upper protective layer 206 is a square having a size of 20 μm×20 μm.

Figure 18B:
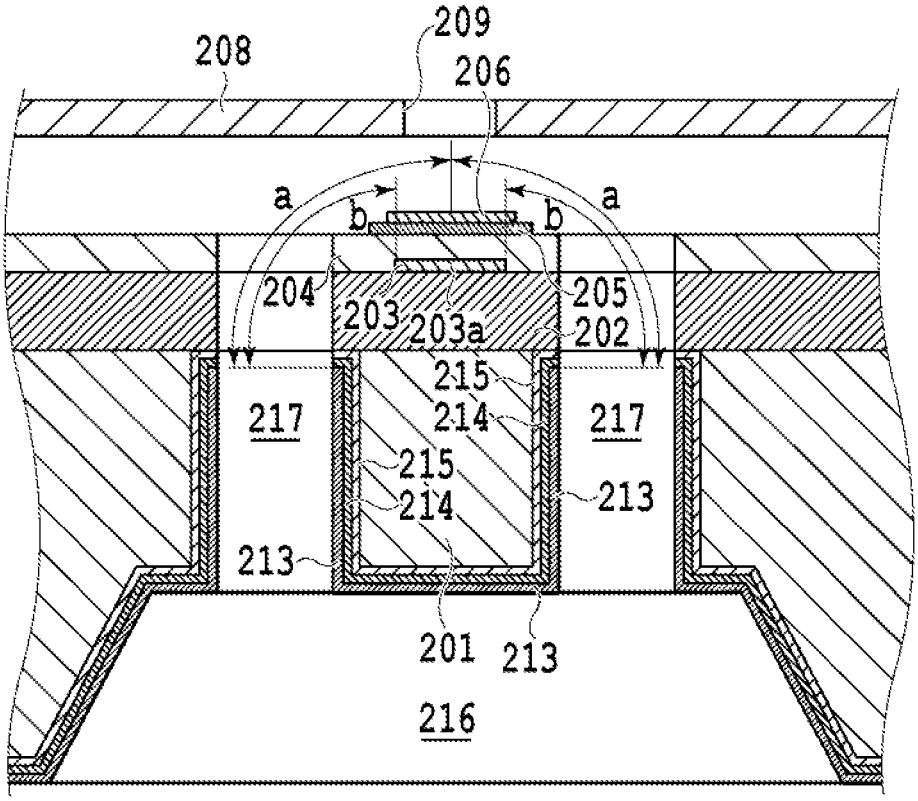
FIG. 18B is a cross-sectional view of the vicinity of a heat acting portion taken along line X-X' of FIG. 18A.

The counter electrode 213 is, as shown in FIG. 18B, formed in particular on a side wall of each liquid supply port 217. Then, the counter electrode 213 and the counter electrode contact layer 214 are formed on an insulating layer 215. Accordingly, the counter electrode 213 can be electrically insulated from the substrate 201. Further, the counter electrode 213 and the counter electrode contact layer 214 each have a thickness of 100 nm. Further, the insulating protective layer 204 and a heat accumulating layer 202 are formed to have thicknesses of 200 to 300 nm and 1700 to 1800 nm, respectively. A distance between a portion of the upper protective layer 206 corresponding to an end of the heating section 203*a* and the top end of the liquid supply port 217 is 20 μm. Further, a distance between the top end of the liquid supply port 217 and a wall surface on which the counter electrode 213 is provided is 2 μm.

In the above configuration, the distance between the counter electrode 213 and the upper protective layer 206 is as follows. As shown in FIG. 18B, a distance between the side wall of the supply port on the side of the counter electrode 213 and a portion of the upper protective layer 206 corresponding to an end of the heating section 203*a* is 22 μm, which is the minimum value "b." Meanwhile, a maximum value "a" of a distance between the upper protective layer and the counter electrode is a distance between the center of the upper protective layer 206 and an end portion of the counter electrode 213, which is 32 μm.

Example 3-2

Example 3-2 shows the case of providing the counter electrode 213 on a side wall of the common liquid supply port 216. FIG. 19 is a cross-sectional view of the vicinity of a heat acting portion of a print head substrate according to the present example. The print head substrate of the present example is provided such that the common liquid supply port 216 penetrates through the substrate 201 from the back side to the front side. Then, the counter electrode 213 is provided particularly on a side wall portion of the common liquid supply port 216.

In the present example, on the heating section 203*a* having a size of 15 μm×15 μm, the insulating protective layer 204 having a thickness of 200 to 300 nm is formed. The contact layer 205 made of tantalum Ta is formed to have a thickness of 100 nm on the insulating protective layer 204, and further the upper protective layer 206 is formed to have a thickness of 100 nm to cover the heating section 203*a*. The upper protective layer 206 is a square having a size of 20 μm×20 μm. A distance between an end portion of the upper protective layer 206 and the top end of the common liquid supply port 216 is 30 μm, and a distance between the top end of the supply port and the counter electrode 213 is 2 μm. The counter electrode 213 is, as shown in FIG. 19, formed not only on the side wall of the common liquid supply port 216 but also from the side wall of the common liquid supply port to the back side of the substrate 201. The counter electrode 213 is formed on the insulating layer 215 via the counter electrode contact layer 214. Further, the counter electrode 213 and the counter electrode contact layer 214 each have a thickness of 100 nm.

In the present example, a distance between the side wall of the common liquid supply port 216 on the side of the counter electrode 213 and a portion of the upper protective layer 206 corresponding to an end of the heating section 203*a* is 32 μm, which is the minimum value "b." Meanwhile, a maximum value "a" of a distance between the upper protective layer and the counter electrode is a distance between a portion of the upper protective layer 206 corresponding to an end of the heating section 203*a* and an end portion of the counter electrode 213, which is 52 μm.

Comparative Example 4

Comparative Example 4 relates to the print head substrate according to the conventional example disclosed in Japanese Patent Laid-Open No. 2008-105364 like Comparative Example 2 as described above. Details of the conventional example are described above with reference to FIGS. 4A to 4C.

Table 3 shows comparison results of a dissolution amount of the upper protective layer 206 in the processing of removing kogation according to Examples 3-1 and 3-2 as described above and that according to Comparative Example 4. More specifically, each ink liquid chamber on the print head substrate is filled with pigment ink, and a voltage of 10 V and a voltage of −10 V are applied to the upper protective layer 206 and the counter electrode 213, respectively, for 60 seconds. A decrease in the film reduction amount of the upper protective layer 206 is obtained, and a maximum value and a minimum value of the film reduction amount are obtained.

TABLE 3

Relation between interelectrode distance and uniformity of film reduction amount

| | a. Maximum distance | b. Minimum distance | a/b | Uniformity of film reduction amount |
|---|---|---|---|---|
| Example 3-1 | 32 μm | 22 μm | 1.45 | ○ |
| Example 3-2 | 52 μm | 32 μm | 1.63 | ○ |
| Comparative Example 4 | 40 μm | 10 μm | 4 | x |

In the study shown in Table 3, the film reduction amount resulting from dissolution of iridium is denoted by "○" when the value obtained by dividing the maximum value of the film reduction amount by the minimum value of the film reduction amount is equal to or less than 2. In Examples 3-1 and 3-2 in which a difference between the maximum distance and the minimum distance is relatively small, that is, when a ratio a/b is relatively small, a difference in the film reduction amount on the upper protective layer 206 is little. On the other hand, in Comparative Example 4 in which a difference between the distances is large, uniformity of the film reduction amount gradually reduced. As a result of the study, it is found that a difference in film reduction amount is generated when the ratio a/b exceeds 2. That is, the smaller the ratio of the maximum distance "a" to the minimum distance "b," the more uniform the electric field strength and the more uniformly the upper protective layer 206 dissolves. In a case where a voltage is generated between the upper protective layer 206 and the counter electrode 213 to dissolve the upper protective layer 206, when the interelectrode distance has the relation of a/b≤2, the dissolution amount of the upper protective layer 206 satisfies a maximum film reduction amount/minimum film reduction amount ≤2. Accordingly, the upper protective layer 206 is dissolved more uniformly.

(Manufacturing Method of the Exemplary Print Head Substrate)

A manufacturing method of the print head substrate of the above-described Example 3-1 will be described. FIGS. 20A to 20F and FIGS. 21A to 21F show the manufacturing method and show cross-sectional views taken along line X-X' of FIG. 16 in each process.

Figure 20A:
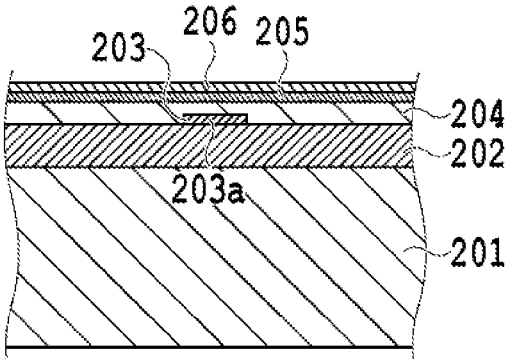
FIGS. 20A to 20F are views showing a manufacturing method of the print head substrate of Example 3-1.
Figure 20B:
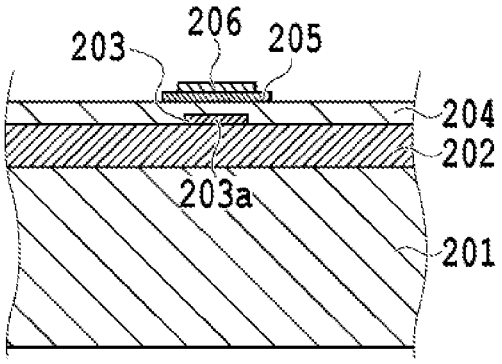

First, as shown in FIG. 20A, a heat accumulating layer 202 of a thermally-oxidized film, a SiO film, or the like is provided on a silicon base 201 on which a driving element circuit is formed by using a CVD process. On the heat accumulating layer, a heat resistor layer 203 and an electrode wiring layer made of Al—Cu (not shown) are deposited by sputtering. A heating section 203*a* is formed by partially removing the electrode wiring layer to form a gap and partially exposing the heat resistor layer 203 corresponding to the removed portion. Next, to cover the heating section 203*a*, a plasma CVD process is used to form an insulating protective layer 204 of a SiN film to have a thickness of 300 nm. Next, a contact layer 205 made of tantalum Ta is formed to have a thickness of 100 nm and an upper protective layer 206 made of iridium Ir is formed to have a thickness of 100 nm by sputtering.

Next, iridium Ir forming the upper protective layer 206 is patterned so as to be left on the heat acting portion, and then the contact layer 205 made of tantalum Ta is patterned. Incidentally, the contact layer 205 acts as wiring for supplying power to the upper protective layer 206 acting as an electrode for removing kogation.

Figure 20C:
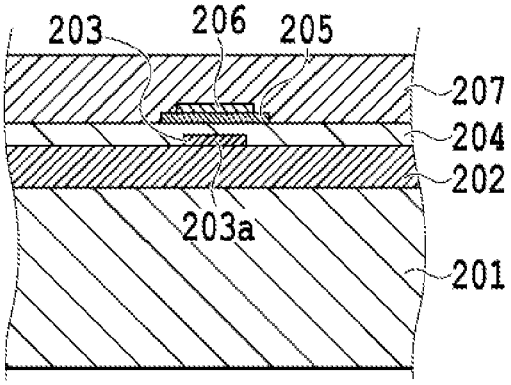

In the process shown in FIG. 20C, a molding material 207 for forming a flow path forming member 208 for forming an ejection port for ejecting ink and an ink flow path is applied to have a predetermined thickness by spin coating, and thereafter, the flow path is patterned. A positive photoresist is used as the molding material 207, applied by spin coating, and baked on a hot plate at a temperature of 120° C. for six minutes to form the molding material 207.

Figure 20D:
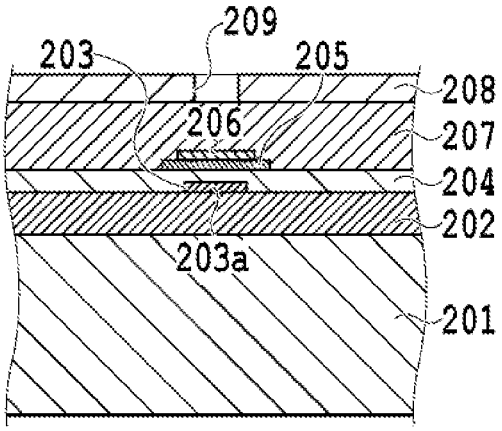

In the process shown in FIG. 20D, a negative photoresist is used as the flow path forming member 208, applied by spin coating, and baked on a hot plate at a temperature of 90° C. for five minutes to form the flow path forming member 208. Thereafter, the flow path forming member 208 is formed by using an i-line stepper, and then an ejection port 209 is formed by exposure.

Figure 20E:
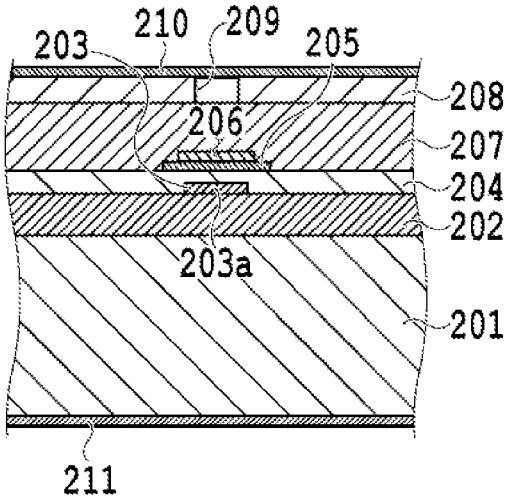

In the process shown in FIG. 20E, after a nozzle protection member (trade name: OBC (manufactured by TOKYO OHKA KOGYO CO., LTD.)) 210 is applied to cover the flow path forming member 208 and the ejection port 209, a polyether amide resin is applied to form an etching mask layer 211 for a common liquid supply port 216.

Figure 20F:
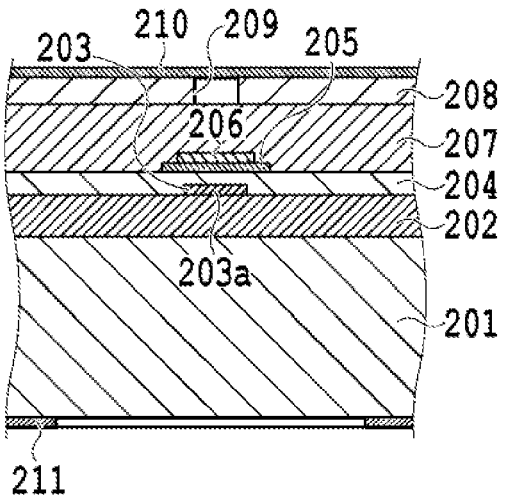

In the process shown in FIG. 20F, a positive photoresist (not shown) is applied to the etching mask layer 211 for the common liquid supply port and a pattern is formed in the shape of the common liquid supply port 216 to which liquid is supplied, and thereafter, a pattern of the common liquid supply port 216 is formed by dry etching.

Figure 21A:
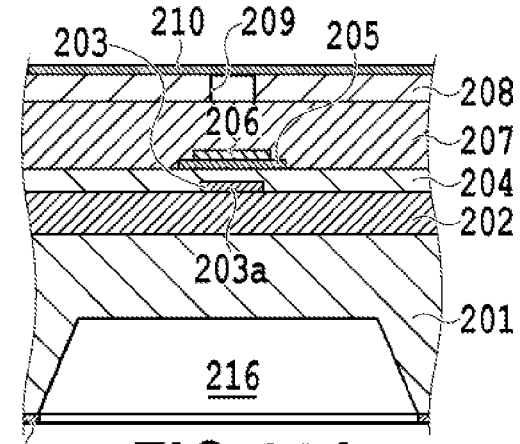
FIGS. 21A to 21F are views similarly showing a manufacturing method of the print head substrate of Example 3-1.

In the process shown in FIG. 21A, the etching mask layer 211 for the common liquid supply port as an etching mask is immersed in a tetramethylammonium hydroxide solution at a temperature of 80° C., anisotropic etching is performed so that the silicon substrate 201 is left to have a thickness of 100 to 200 μm, and the common liquid supply port 216 is formed.

Figure 21B:
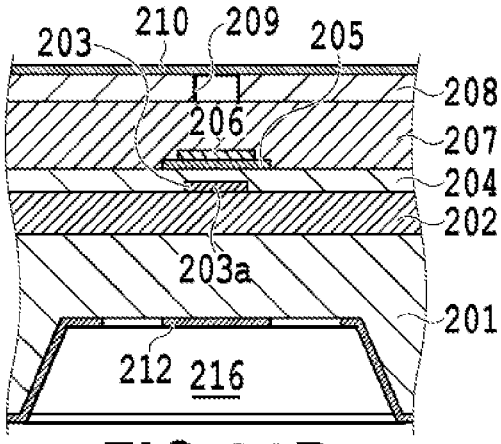

In the process shown in FIG. 21B, after removing the etching mask layer 211 for the common liquid supply port, an etching mask layer 212 for a liquid supply port 217 is patterned and formed.

Figure 21C:
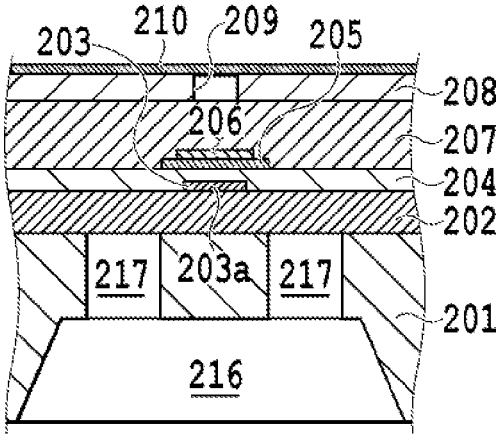

In the process shown in FIG. 21C, after removing the silicon substrate 201 by dry etching from the back side before reaching the heat accumulating layer 202, the etching mask layer 212 for a liquid supply port is removed.

Figure 21D:
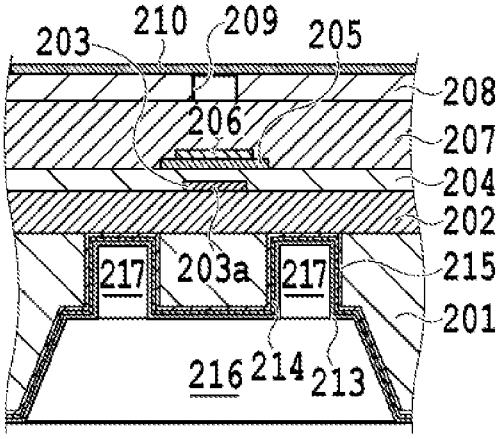

In the process shown in FIG. 21D, from the back side of the substrate, an insulating layer 215 made of $SiO_2$ having a thickness of 100 nm, a counter electrode contact layer 214 made of Ta having a thickness of 100 nm, and a counter electrode 213 made of Ir having a thickness of 100 nm are formed by sputtering on a side wall surface opened by dry etching as shown in FIG. 21C.

Figure 21E:
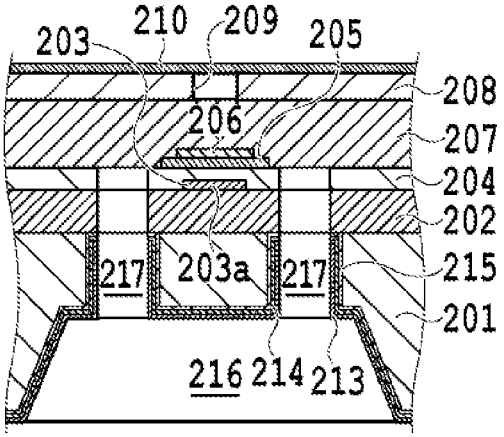

In the process shown in FIG. 21E, the counter electrode 213, the counter electrode contact layer 214, the insulating layer 215, the heat accumulating layer 202, and the insulating protective layer 204 are removed by dry etching.

Figure 21F:
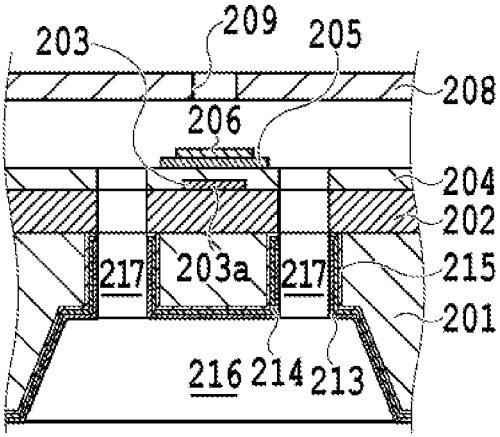

In the process shown in FIG. 21F, after removing the OBC 210, a positive photoresist forming the molding material 207 is immersed in methyl lactate which is heated to a temperature of about 40° C., and the molding material 207 is removed by dissolution at a time, a photosensitive resin material is completely cured in an oven at a temperature of 200° C., and a liquid ejection head is molded.

Fourth Embodiment

Figure 22:
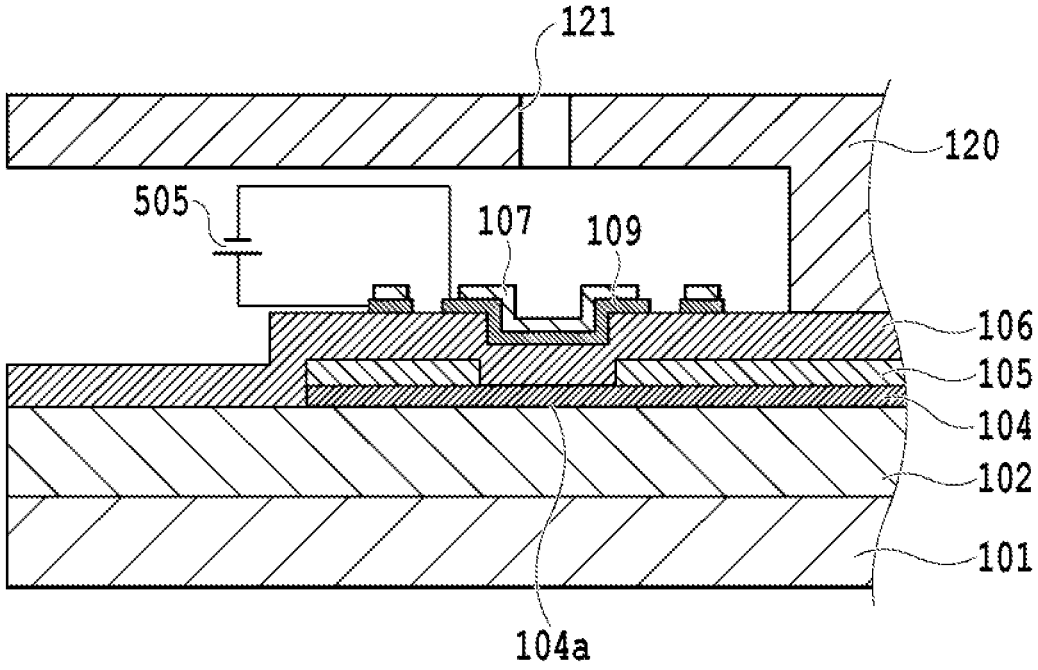
FIG. 22 is a cross-sectional view, corresponding to FIG. 5, of the vicinity of a heat acting portion of a print head substrate according to a fourth embodiment of the present invention.

FIG. 22 is a cross-sectional view taken along line X-X' of FIG. 3 according to a fourth embodiment of the present invention. In the fourth embodiment of the present invention, counter electrodes and an upper protective layer are arranged on the same plane, that is, the counter electrodes are laminated and formed on a substrate as a same layer as the upper protective layer. In the present embodiment, a difference between the longest distance "a" and the shortest distance "b" between the upper protective layer and the counter electrode is reduced by arranging the counter electrodes symmetric with respect to the upper protective layer. An aspect that is different from the first embodiment will be mainly described in the following.

In the present embodiment, counter electrodes 122 made of iridium Ir are provided on a protective layer 106. That is, the counter electrodes are connected to counter electrode wiring made of Ta provided on the protective layer 106, and are connected to an external power supply. Further, the counter electrodes and the counter electrode wiring are formed simultaneously in the process of forming an upper protective layer 107 and a contact layer 109, respectively. In the processing of removing kogation, the counter electrodes are used so that a positive potential is produced at the upper protective layer 107 and a negative potential is produced at the counter electrodes to generate an electrochemical reaction on the upper protective layer, thereby dissolving the upper protective layer, in a state in which an ink flow path and a liquid chamber are filled with ink. That is, on a print head substrate of the present embodiment, counter electrodes are provided on a portion on the same plane as the upper protective layer, and an electrode for generating a potential difference between the counter electrodes and the upper protective layer and others are provided.

A description will be given of Examples 4-1 to 4-3 in connection with the positional relation between the upper protective layer and the counter electrodes and the resulting uniformity of a dissolution amount of the upper protective layer, in comparison with Comparative Examples 5 and 6.

Example 4-1

Figure 23A:
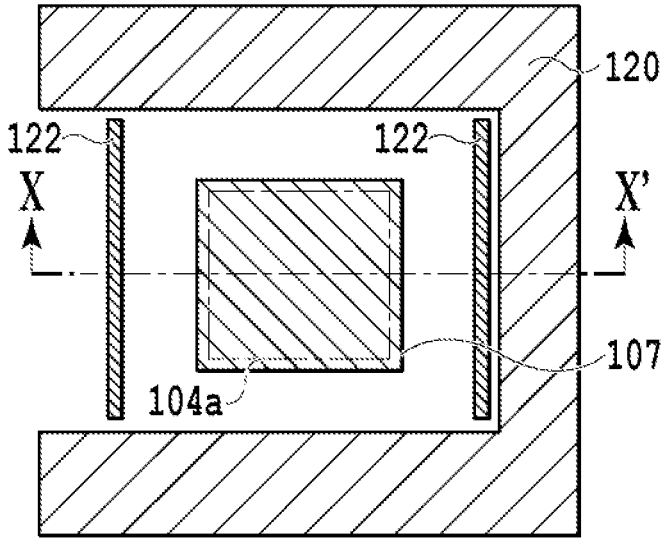
FIG. 23A is a top view of the print head substrate as viewed from the top of the ejection port according to examples and comparative examples of the fourth embodiment.
Figure 23B:
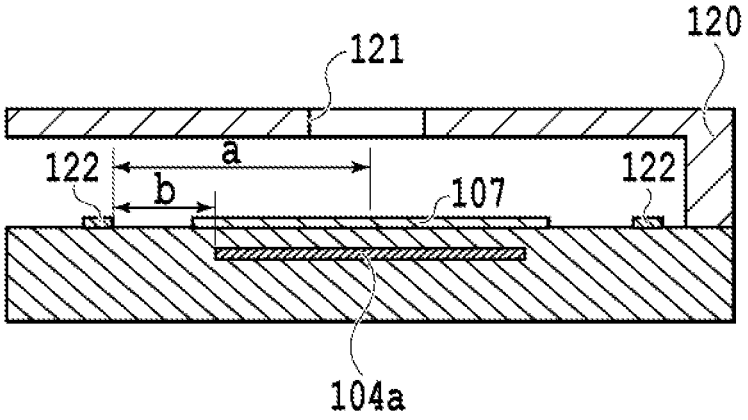
FIG. 23B is a cross-sectional view taken along line X-X' of FIG. 23A.

FIG. 23A is a top view of the vicinity of a heat acting portion corresponding to one ejection port of a print head as viewed from the ejection port according to Example 4-1, and in particular shows the positional relation between the upper protective layer and the counter electrodes which are formed on the same layer as the upper protective layer. FIG. 23B is a cross-sectional view taken along line X-X' of FIG. 23A.

As shown in these figures, in the present example, a heating section 104*a* has a size of 30 μm×30 μm, and an insulating protective layer having a thickness of 200 to 300 nm is formed on the heating section 104*a*. Further, on the insulating protective layer, a contact layer of Ta having a thickness of 100 nm is formed. An upper protective layer 107 is formed to have a thickness of 100 nm via the above-mentioned films above the heating section. The upper protective layer is patterned in a square having a size of the 32.5 μm×32.5 μm. Above these films and layers, a flow path forming member 120 is provided. The flow path forming member 120 defines a liquid chamber for generating a bubble in ink.

In the present example, counter electrodes 122 are provided on the film inside the liquid chamber as shown in FIG. 23B. The counter electrodes 122 are separated from ends of the heating section by 25 μm, and strip patterns as shown in FIG. 23A are arranged symmetrically around the heating section. In the present example, a maximum value "a" of the distance between the upper protective layer 107 as an electrode for removing kogation and the counter electrode 122 is, as shown in FIG. 23B, a distance between the center of the upper protective layer 107 and an end of the counter electrode 122, which is 40 μm. Meanwhile, a minimum value "b" is the distance between an end portion of the heating section on the upper protective layer 107 and the counter electrode 122, which is 25 μm.

Example 4-2

The present example will also be described with reference to FIGS. 23A and 23B. In this additional Example 4-2, like Example 4-1, the counter electrodes 122 are provided on the layer inside the liquid chamber as shown in FIG. 23A. In the present example, the distance between an end of the heating section and the counter electrode 122 is 20 μm, and the distance between the upper protective layer 107 and the counter electrode 122 is smaller as compared to Example 4-1.

In Example 4-2, the maximum value "a" between the upper protective layer 107 and the counter electrode 122 is the distance between a portion on the upper protective layer 107 corresponding to a center part of the heating section 104*a* and an end portion of the counter electrode 122, as shown in FIG. 23B, and is 35 μm. Meanwhile, the minimum value "b" is 20 μm.

Example 4-3

The present example will also be described with reference to FIGS. 23A and 23B. In Example 4-3, like Example 4-1, the counter electrodes 122 are provided on the layer inside the liquid chamber as shown in FIG. 23A. In the present example, the distance between an end of the heating section and the counter electrode 122 is 15 μm, and the distance between the upper protective layer 107 and the counter electrode 122 is smaller as compared to Examples 4-1 and 4-2.

In Example 4-3, the maximum value "a" between the upper protective layer 107 and the counter electrode 122 is the distance between a portion on the upper protective layer 107 corresponding to a center part of the heating section 104*a* and an end portion of the counter electrode 122, as shown in FIG. 23B, and is 30 μm. Meanwhile, the minimum value "b" is 15 μm.

Comparative Example 5

In the present comparative example, like Example 4-1, the counter electrodes 122 are provided on the layer inside the liquid chamber as shown in FIG. 23A. In the present comparative example, the distance between an end of the heating section and the counter electrode 122 is 13 μm.

In Comparative Example 5, the maximum value "a" between the upper protective layer 107 and the counter electrode 122 is the distance between a portion on the upper protective layer 107 corresponding to a center part of the heating section 104*a* and an end portion of the counter electrode 122, as shown in FIG. 23B, and is 28 μm. Meanwhile, the minimum value "b" is 13 μm.

Comparative Example 6

Comparative Example 6 is the conventional configuration disclosed in Japanese Patent Laid-Open No. 2008-105364 and, as shown in FIG. 4B, the counter electrodes are located in parallel with the upper protective layer on the substrate. In Comparative Example 6, as described above, the maximum value "a" between the upper protective layer and the counter electrode is 40 μm. Meanwhile, the minimum value "b" is 10 μm.

By using the print head according to Examples 4-1 to 4-3 and Comparative Examples 5 and 6 as described above, a dissolution amount of the upper protective layer is studied. In this study, the ink liquid chamber is filled with pigment ink, and a voltage of 10 V and a voltage of −10 V are applied to the upper protective layer and the counter electrode, respectively, for 60 seconds. A decrease in the thickness of the upper protective layer (film reduction amount) is obtained, and a maximum value and a minimum value of the film reduction amount are obtained. The results are shown in Table 4.

TABLE 4

Relation between interelectrode distance and uniformity of film reduction amount

| | a. Maximum distance | b. Minimum distance | a/b | Uniformity of film reduction amount |
|---|---|---|---|---|
| Example 4-1 | 40 μm | 25 μm | 1.6 | ○ |
| Example 4-2 | 35 μm | 20 μm | 1.75 | ○ |
| Example 4-3 | 30 μm | 15 μm | 2.0 | ○ |
| Comparative Example 5 | 28 μm | 13 μm | 2.15 | Δ |
| Comparative Example 6 | 40 μm | 10 μm | 4.0 | x |

In Table 4, uniformity of the film reduction amount resulting from dissolution of iridium which forms an upper protective layer is denoted by "○," "Δ," and "×" respectively when the value obtained by dividing the maximum value of the film reduction amount by the minimum value of the film reduction amount is equal to or less than 2, when the value is equal to or greater than 2 and equal to or less than 5, and when the value is equal to or greater than 5.

As can be seen from Table 4, in Example 4-1 in which the difference between the maximum distance "a" and the minimum distance "b" is small, that is, when a ratio a/b is small, a difference in the film reduction amount on the upper protective layer is little. In Examples 4-2 and 4-3, as a difference between the distances increases, that is, as a ratio between the distances increases, uniformity of the film reduction amount gradually decreases, and as a difference between the distances increases as in Comparative Examples 5 and 6, a difference in the film reduction amount exceeds two times.

The smaller the ratio of the maximum distance "a" to the minimum distance "b," the more uniformly the upper protective layer dissolves. It is considered that this is because the smaller the ratio, the more uniform the electric field strength. In view of Table 4, in a case where a potential is produced between the upper protective layer and the counter electrode to dissolve the upper protective layer, when a ratio a/b between the distances has the relation of $1<a/b\leq 2$, the dissolution amount of the upper protective layer satisfies a maximum film reduction amount/minimum film reduction amount ≤2. Accordingly, the upper protective layer is dissolved more uniformly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-217202, filed Oct. 18, 2013, which is hereby incorporated by reference herein in its entirety.

What is claimed is:

1. A liquid ejection head comprising:

a substrate having a heating section and a protective film that has an area overlapping with the heating section when viewed from a direction orthogonal to a face of the substrate, an electrode capable of generating a voltage between the protective film and the electrode;

a flow path formed between a surface of the protective film and a surface of the electrode; and an ejection port, liquid being ejected from the ejection port with use of heat generated by the heating section via the protective film, wherein the protective film and the electrode are arranged such that a distance in the flow path between the area of the protective film and the electrode corresponding to the area satisfies $1<a/b\leq 2$ when a maximum distance is set as "a" and a minimum distance is set as "b".

2. The liquid ejection head according to claim 1, wherein the electrode is provided symmetrically with respect to the protective film.

3. The liquid ejection head according to claim 1, wherein the electrode is laminated as the same layer as the protective film.

4. The liquid ejection head according to claim 1, wherein the electrode is provided on a surface opposite to the face of the substrate.

5. The liquid ejection head according to claim 1, wherein the electrode is provided on a step portion that is provided on the substrate.

6. The liquid ejection head according to claim 1, wherein the electrode is provided on a wall portion forming a liquid supply port for supplying liquid on the protective film.

7. The liquid ejection head according to claim 1, wherein the protective film contains iridium.

8. The liquid ejection head according to claim 1, wherein the protective film contains material eluted to liquid when a voltage is generated between the protective film and the electrode.

9. A liquid ejection apparatus comprising:

the liquid ejection head according to claim 1; and a control unit configured to perform control to produce a potential difference between the protective film and the electrode.

10. The liquid ejection head according to claim 2, wherein the electrode is laminated as the same layer as the protective film.

11. The liquid ejection head according to claim 2, wherein the electrode is provided on a surface opposite to the face of the substrate.

12. The liquid ejection head according to claim 2, wherein the electrode is provided on a step portion that is provided on the substrate.

13. The liquid ejection head according to claim 2, wherein the electrode is provided on a wall portion forming a liquid supply port for supplying liquid on the protective film.

14. The liquid ejection head according to claim 2, wherein the protective film contains iridium.

15. The liquid ejection head according to claim 2, wherein the protective film contains material eluted to liquid when a voltage is generated between the protective film and the electrode.

16. A liquid ejection apparatus comprising:

the liquid ejection head according to claim 2; and a control unit configured to perform control to produce a potential difference between the protective film and the electrode.

17. The liquid ejection head according to claim 1, wherein the liquid ejection head comprises a plurality of electrodes, when viewed from the orthogonal direction, a first electrode of the plurality of electrodes is provided on a first side of the heating section and a second electrode of the plurality of electrodes is provided on a second side of the heating section that is an opposite side to the first side with respect to the heating section.

18. The liquid ejection head according to claim 1, wherein the distance is a distance between the area of the protective film and the electrode that is provided at nearest to the area.

* * * * *